US007028364B2

(12) United States Patent
Policicchio et al.

(10) Patent No.: US 7,028,364 B2
(45) Date of Patent: Apr. 18, 2006

(54) CLEANING PADS

(75) Inventors: Nicola John Policicchio, Mason, OH (US); Preston James Rhamy, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 10/700,988

(22) Filed: Nov. 4, 2003

(65) Prior Publication Data

US 2004/0128786 A1 Jul. 8, 2004

Related U.S. Application Data

(63) Continuation-in-part of application No. 09/831,480, filed on May 9, 2001.

(60) Provisional application No. 60/423,484, filed on Nov. 4, 2002.

(51) Int. Cl.

| | |
|---|---|
| *A47L 13/10* | (2006.01) |
| *A47L 13/20* | (2006.01) |
| *A47L 13/46* | (2006.01) |

(52) U.S. Cl. ..... 15/228; 15/231; 15/209.1

(58) Field of Classification Search ..... 15/208, 15/209.1, 210.1, 231, 228, 229.1, 232; D32/50
See application file for complete search history.

(56) References Cited

U.S. PATENT DOCUMENTS

| | | | | |
|---|---|---|---|---|
| 3,376,595 | A * | 4/1968 | Cole | 15/228 |
| 3,991,432 | A * | 11/1976 | Griffin et al. | 15/229.8 |
| 4,852,210 | A * | 8/1989 | Krajicek | 15/228 |
| 6,807,702 | B1 * | 10/2004 | Keck et al. | 15/104.94 |
| 6,842,936 | B1 * | 1/2005 | Policicchio et al. | 15/104.94 |

* cited by examiner

*Primary Examiner*—Robert J. Warden, Sr.
*Assistant Examiner*—Laura C Guidotti
(74) *Attorney, Agent, or Firm*—Thibault Fayette; Brahm J. Corstanje; Kim William Zerby

(57) ABSTRACT

The present invention provides a cleaning pad which can be used with various cleaning implement. The cleaning pad has an absorbent layer, attachment wings which can be attached to grippers located on the top surface of the mop head of a first cleaning implement and loop fasteners which can be attached to hook fasteners located on the bottom surface of the mop head of a second implement.

33 Claims, 16 Drawing Sheets

CLEANING PADS

CROSS REFERENCE TO RELATED APPLICATIONS

This application is a continuation-in-part of U.S. application Ser. No. 09/831,480, filed May 9, 2001, and also claims the benefit of U.S. Provisional Application Ser. No. 60/423,484, filed Nov. 4, 2002 under 35 U.S.C. § 119(e).

TECHNICAL FIELD

The present invention relates to cleaning pads useful for removing soils from hard surfaces and which can be used with a variety of cleaning implements. The cleaning pads comprise structures allowing a user to removably attach the cleaning pads to retaining means. The present invention further relates to methods of using the cleaning pads with a cleaning implement to clean hard surfaces.

BACKGROUND OF THE INVENTION

The literature is replete with products capable of cleaning hard surfaces such as ceramic tile floors, hardwood floors, counter tops and the like. In the context of cleaning floors, and in particular in the context of cleaning floors with a cleaning solution, numerous devices are described comprising a handle rotatably connected to a mop head having retaining means for maintaining an absorbent cleaning pad attached during the cleaning operation. One example of such retaining means can be found in the SWIFFER WETJET® cleaning implement, sold by The Procter & Gamble Company, and which includes hook fasteners, which are located at the bottom surface of the mop head. These hook fasteners can conveniently engage and retain loop fasteners located on a top surface of a cleaning pad. Other examples of such retaining means can be found in the SWIFFER® cleaning implement, sold by The Procter & Gamble Company, the CLOROX® READY-MOP® cleaning implement, sold by The Clorox Company and on the GO-MOP™ cleaning implement, sold by the S.C. Johnson Company, which all have slitted attachment structures located on the top of the mop head. These deflectable slitted structures can engage at least a portion of a cleaning pad and, as a result, can retain a cleaning pad about the mop head of the implement.

These cleaning implements can be viewed as "pad specific" in the sense that they can only be used with cleaning pads which have retainable means corresponding to the type of retaining means used with a particular cleaning implement.

The "pad specificity" of each cleaning implement can be a source of confusion for consumers who already own a cleaning implement, and wish to purchase additional pads for use with their cleaning implement. For example, a consumer who has purchased a cleaning implement having deflectable slitted structures, might mistakenly purchase refills of cleaning pads having loop fasteners and realize that this type of cleaning pad cannot be effectively attached to this type of implement.

It is therefore one object of this invention to provide a cleaning pad which can be used with a variety of cleaning implements independently of the retaining means of the cleaning implement.

In addition, it has been observed that cleaning pads which are originally designed to be used with a cleaning implement having slitted structures, typically have attachment wings which can be mechanically engaged by the slitted structures located on the top surface of a mop head. These attachment wings can be made of low cost fibrous materials. Despite the presence of grabable fibers in these type of materials, the attachment wings are not suitably designed to stay attached to hook fasteners of an implement and tend to detach from the mop head either during the cleaning operation or when the user "lifts" the mop head from the floor surface. While "specialized loop" materials are available on the market, these are relatively expensive and can substantially increase the manufacturing cost of the pads.

It is therefore another object of this invention to provide an improved cleaning pad which does not get prematurely detached from the mop head by having suitable loop fastener materials as well as proper design configurations.

SUMMARY OF THE INVENTION

The present invention relates to cleaning pads which are usable with a variety of cleaning implements having different type of retaining means for removably engaging and retaining a cleaning pad. In one embodiment, a cleaning pad can have an absorbent layer having attachment wing portions which can be removably attached to retaining means located on the top surface of the mop head of a first cleaning implement as well as mechanical fasteners which can be removably attached to retaining means located on the bottom surface of a second cleaning implement. In a preferred embodiment, at least one of the attachment wing portions of the cleaning pad has a notch such that the liquid delivered by a nozzle located on the mop head of an implement is not blocked (or obstructed) by the attachment wing portion having the notch.

All documents cited herein are, in relevant part, incorporated herein by reference; the citation of any document is not to be construed as an admission that it is prior art with respect to the present invention.

It should be understood that every maximum numerical limitation given throughout this specification will include every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

All parts, ratios, and percentages herein, in the Specification, Examples, and claims, are by weight and all numerical limits are used with the normal degree of accuracy afforded by the art, unless otherwise specified.

BRIEF DESCRIPTION OF THE DRAWINGS

FIG. 17 is an isometric view of one embodiment of the invention shown in an "open" position;

DETAILED DESCRIPTION OF THE INVENTION

Figure 1:
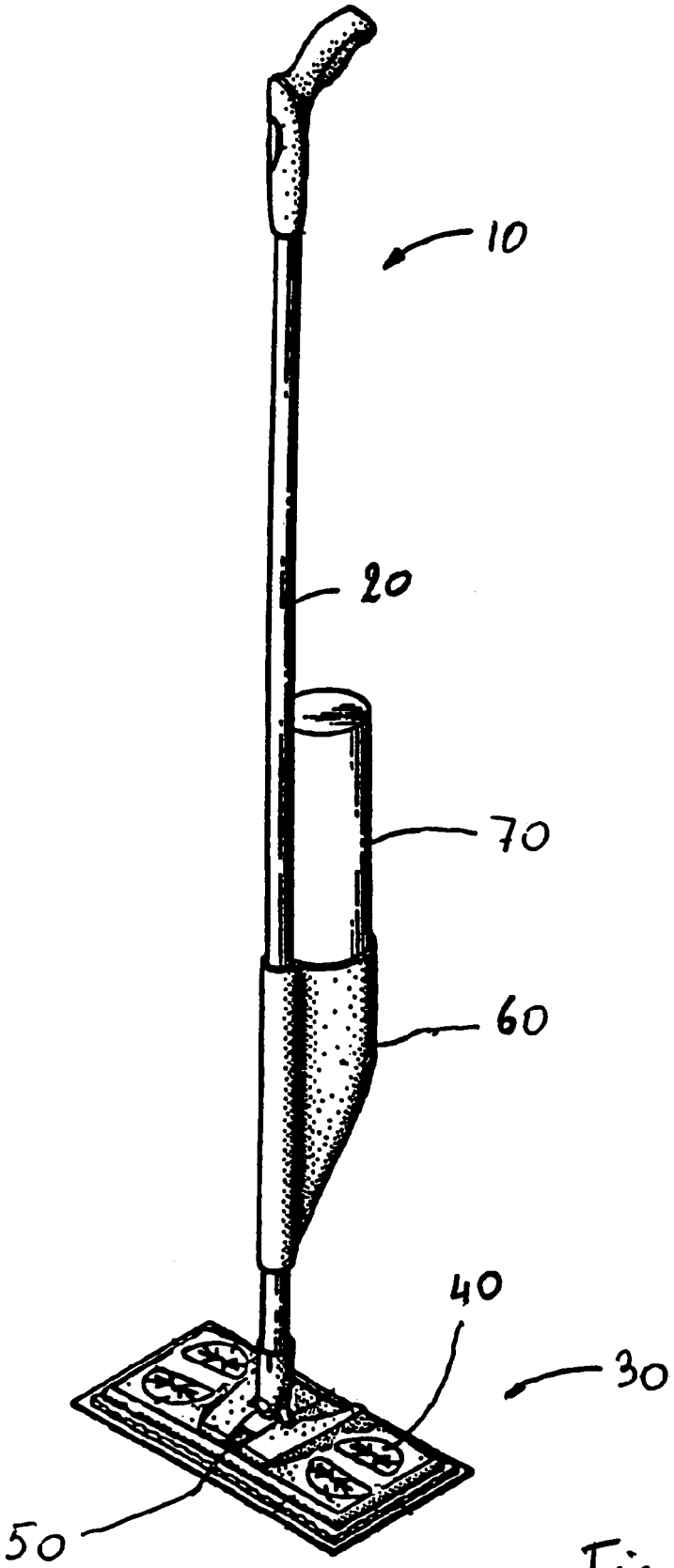
FIG. 1 is an isometric view of one example of a cleaning implement which can be used with the present invention.

Reference will now be made in detail to the present preferred embodiments of the invention, examples of which are illustrated in the accompanying drawings wherein like numerals indicate the same elements throughout the views and wherein reference numerals having the same last two digits (e.g., 20 and 120) connote similar elements.

I. Definitions

As used herein, the term "comprising" means that the various components, ingredients, or steps, can be conjointly employed in practicing the present invention. Accordingly, the term "comprising" encompasses the more restrictive terms "consisting essentially of" and "consisting of."

As used herein, the term "direct fluid communication" means that fluid can transfer readily between two cleaning pad components or layers (e.g., the floor sheet and the absorbent layer) without substantial accumulation, transport, or restriction by an interposed layer. For example, tissues, nonwoven webs, construction adhesives, and the like can be present between the two distinct components while maintaining "direct fluid communication", as long as they do not substantially impede or restrict fluid as it passes from one component or layer to another.

As used herein, the term "x-y dimension" refers to the plane orthogonal to the thickness of the cleaning pad, or a component thereof. The x and y dimensions correspond to the length and width, respectively, of the cleaning pad or a pad component. In general, when the cleaning pad is used in conjunction with a handle, the implement will be moved in a direction parallel to the y-dimension (or width) of the pad.

As used herein, the term "z-dimension" refers to the dimension orthogonal to the length and width of the cleaning pad of the present invention, or a component thereof. The z-dimension therefore corresponds to the thickness of the cleaning pad or a pad component.

Of course, the present invention is not limited to cleaning pads having four sides. Other shapes, such as circular, elliptical, and the like, can also be used. When determining the width of the pad at any point in the z-dimension, it is understood that the pad is assessed according to its intended use.

As used herein, the term "layer" refers to a member or component of a cleaning pad whose primary dimension is x-y, i.e., along its length and width. It should be understood that the term layer is not necessarily limited to single layers or sheets of material. Thus a layer can comprise laminates or combinations of several sheets or webs of the requisite type of materials. Accordingly, the term "layer" includes the terms "layers" and "layered."

As used herein, the term "hydrophilic" is used to refer to surfaces that are wettable by aqueous fluids deposited thereon. Hydrophilicity and wettability are typically defined in terms of contact angle and the surface tension of the fluids and solid surfaces involved. This is discussed in detail in the American Chemical Society publication entitled *Contact Angle, Wettability and Adhesion*, edited by Robert F. Gould (Copyright 1964), which is hereby incorporated herein by reference. A surface is said to be wetted by a fluid (i.e., hydrophilic) when either the contact angle between the fluid and the surface is less than 90°, or when the fluid tends to spread spontaneously across the surface, both conditions normally co-existing. Conversely, a surface is considered to be "hydrophobic" if the contact angle is greater than 90° and the fluid does not spread spontaneously across the surface.

As used herein, the term "top surface" when referring to a layer of a cleaning pad or when referring to a mop head, means the surface which is the furthest away from the floor surface during normal cleaning conditions, i.e. the pad being "sandwiched" between the floor surface and the mop head.

For purposes of the present invention, an "upper" layer of a cleaning pad is a layer that is relatively further away from the surface that is to be cleaned (i.e., in the implement context, relatively closer to the implement handle during use). The term "lower" layer conversely means a layer of a cleaning pad that is relatively closer to the surface that is to be cleaned (i.e., in the implement context, relatively further away from the implement handle during use). As such, the floor sheet is preferably the lower-most layer and the absorbent layer is preferably an upper layer relative to the floor sheet. The terms "upper" and "lower" are similarly used when referring to layers that are multi-ply (e.g., when the floor sheet is a two-ply material). In terms of sequential ordering of layers (e.g., first layer, second layer, and third layer), a first layer is a "lower" layer relative to a second layer. Conversely, a third layer is an "upper" layer relative to a second layer. The terms "above" and "below" are used to describe relative locations of two or more materials in a cleaning pad's thickness. By way of illustration, a material A is "above" material B if material B is positioned closer to floor surface than material A during normal cleaning conditions. Similarly, material B is "below" material A in this illustration.

II. Cleaning Implements

Various type of wet cleaning implements are available to users for cleaning a floor surface.

Conventional wet cleaning implements typically have a handle connected to a support head which can have an absorbent material in the form of a sponge or strings of an absorbent material.

"Modern" wet cleaning implements have a handle which is rotatably connected to a mop head. The mop head of these implements can have retaining means located on the top or the bottom surface of the mop head for mechanically engaging and retaining an absorbent cleaning pad. Some of these wet cleaning implements comprise a built-in fluid delivery mechanism for delivering a cleaning solution onto a floor surface. The cleaning solution can be stored in a container which is removably attachable to the fluid delivery mechanism. Non-limiting examples of "modern" cleaning implement include the SWIFFER® and SWIFFER WETJET® cleaning implements sold by The Procter & Gamble Company, the CLOROX READY-MOP® sold by The Clorox Company and the GRABBIT GO-MOP™ sold by The S.C. Johnson company.

FIG. 1 shows one example of such a "Modern" wet cleaning implement 10 having a handle 20, rotatably connected to a mop head 30 which includes retaining means 40 located on the top surface of the mop head and which are suitable for mechanically engaging and retaining a cleaning pad of the present invention. The retaining means 40 located on the top surface of the mop head can be deflectable slitted structures such as the ones described in U.S. Pat. No. 6,305,046 to Kingry et al., issued Oct. 23, 2001, and assigned to The Procter & Gamble Company, but one skilled in the art will understand that other kinds of retaining means are suitable to retain a cleaning pad and provide the same benefits. Non-limiting example of retaining means located on the top surface of a mop head include clamps, clips, mechanical fasteners such as hook or loop fasteners, pins and the like such as the one described in U.S. Pat. No. 4,991,250 to Young, issued Feb. 12, 1991, in U.S. Pat. No. 3,698,030 to Lockett, issued Oct. 17, 1972. One skilled in the art will also understand that the previously described retaining means can also be located on the side edges of a mop head and still provide the same benefits. The mop head 30 in the example shown also comprises a nozzle 50 located substantially adjacent to the leading edge of the mop head 30 and which is in fluid communication with a fluid delivery mechanism (not shown) located in a housing 60 and a container 70 comprising a cleaning solution. One skilled in the art will understand that the nozzle can alternatively be connected to the handle of the implement and still provide the same benefits.

Figure 2:
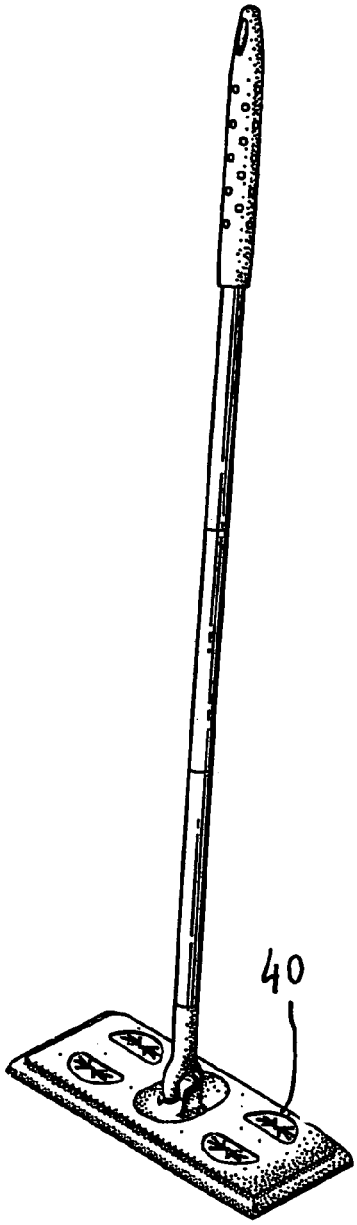
FIG. 2 is an isometric view of another example of a cleaning implement which can be used with the present invention.

FIG. 2 shows one example of a cleaning implement which does not include a built-in fluid delivery mechanism but which comprises retaining means 40 located on the top surface of the mop head such as the ones previously described.

Figure 3:
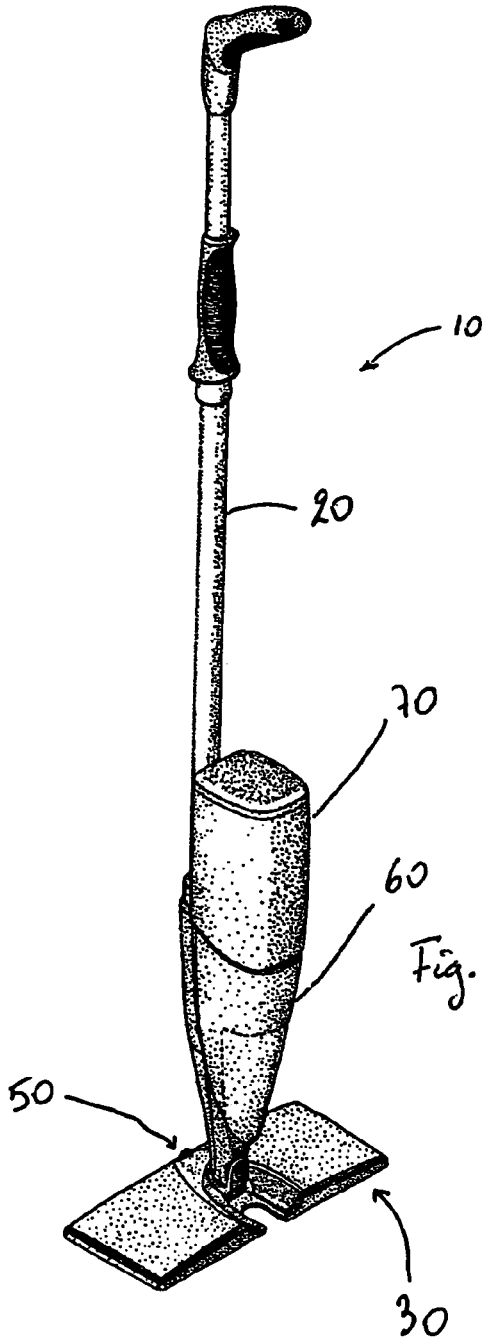
FIG. 3 is an isometric view of another example of a cleaning implement which can be used with the present invention.
Figure 4:
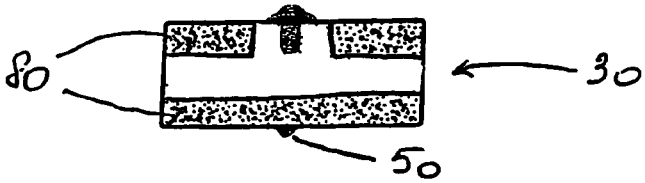
FIG. 4 is a bottom view of the cleaning implement shown in FIG. 3.

FIGS. 3 and 4 show another example of such a "Modern" wet cleaning implement 10 which is similar to the wet cleaning implement shown in FIG. 1 but which includes retaining means 80 located on the bottom surface of the mop head 30 as shown in FIG. 4. The retaining means 80 located on the bottom surface of the mop head 30 are suitable for mechanically engaging and retaining a cleaning pad of the present invention. The retaining means 80 can be hook fasteners attached to the bottom surface of the mop head and which are suitable for mechanically engaging and retaining loop fasteners. One skilled in the art will understand that the retaining means 80 can also be loop fasteners attached to the bottom surface of the mop head and which are engageable and retainable by hook fasteners and still provide the same benefits.

The cleaning pads of the present invention which are described hereinafter are intended to be usable with various type of cleaning implements, including but not limited to the ones previously described.

III. Cleaning Pads

In one aspect, the present invention relates to a cleaning pad, preferably disposable, which is removably attachable to various types of cleaning implements, the cleaning pad comprising:

(a) at least one absorbent layer;

(b) at least one attachment portion connected to the cleaning pad and capable of being engaged by retaining means located on the top of a mop head and/or by retaining means located on the bottom of a mop head;

(c) at least a first retainable means for removably attaching the cleaning pad to retaining means located on the top surface of a cleaning implement;

(d) at least a second retaining means for removably attaching the cleaning pad to retaining means located at the bottom surface of a cleaning implement;

(e) optionally at least one notch made in a portion of the cleaning pad such that the cleaning pad can be attached to attachment structures located on the top of the mop head without blocking the cleaning solution being delivered by a nozzle also located on the mop head;

(f) optionally, a liquid pervious floor sheet; wherein the liquid pervious floor sheet is preferably an apertured formed film, more preferably a macroscopically expanded three-dimensional plastic web, having tapered or funnel-shaped apertures and/or surface aberrations and preferably comprising a hydrophobic material;

(g) optionally, multiple planar surfaces;

(h) optionally, at least one functional cuff, preferably at least one free-floating, looped functional cuff;

(i) a $T_{1200}$ absorbent capacity of at least 5 g/g, preferably at least 10 g/g, more preferably of at least 20 g/g;

(j) optionally, a density gradient throughout at least one absorbent layer;

wherein the density gradient preferably comprises a first absorbent layer having a density of from about 0.01 g/cm$^3$ to about 0.15 g/cm$^3$, preferably from about 0.03 g/cm$^3$ to about 0.1 g/cm$^3$, and more preferably from about 0.04 g/cm$^3$ to about 0.06 g/cm$^3$, and a second absorbent layer having a density of from about 0.04 g/cm$^3$ to about 0.2 g/cm$^3$, preferably from about 0.1 g/cm$^3$ to about 0.2 g/cm$^3$, and more preferably from about 0.12 g/cm$^3$ to about 0.17 g/cm$^3$; wherein the density of the first absorbent layer is about 0.04 g/cm$^3$, preferably about 0.07 g/cm$^3$, and more preferably about 0.1 g/cm$^3$, less than the density of the second absorbent layer;

(k) optionally, at least one adhesive scrubbing strip, preferably comprising a material selected from the group consisting of nylon, polyester, polypropylene, abrasive material, and mixtures thereof; and During the effort to develop the present cleaning pads, it was discovered that the possibility to use a cleaning pad with various type of cleaning implements having different kind of retaining means is related to the ability of the cleaning pad to have retainable means which can be mechanically engaged and retained by various retaining means.

In one embodiment, a cleaning pad 11 comprises at least an absorbent layer 21 which serves to retain any fluid and/or soil absorbed by the cleaning pad during its use with a cleaning implement. The absorbent layer(s) of the cleaning pad can be made of any type of absorbent material known in the art such as those described in PCT application Serial No. WO 00/27271 to Policicchio et al, filed Nov. 9, 1999, and assigned to The Procter & Gamble Company. Non-limiting examples of absorbent materials suitable for the absorbent layer of a cleaning pad are described in Section V infra.

Figure 5:
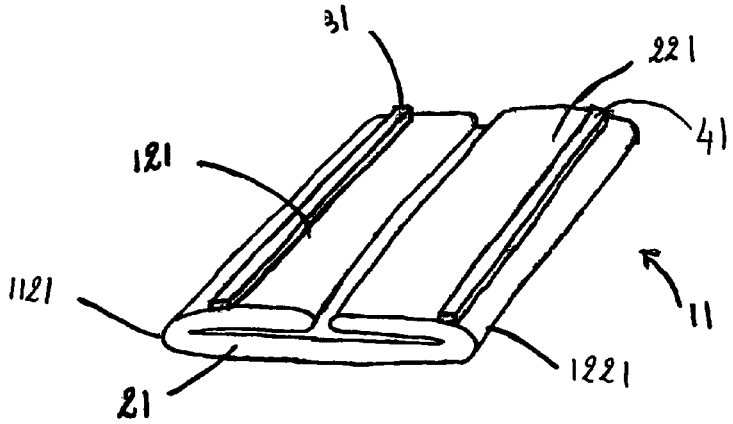
FIG. 5 is an isometric view of a cleaning pad of the present invention.
Figure 6:
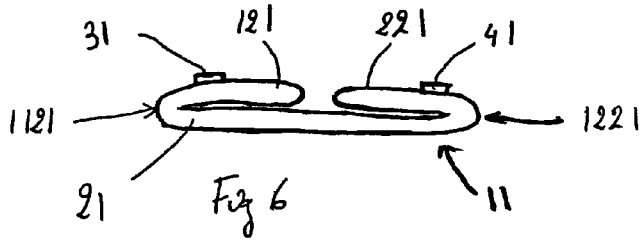
FIG. 6 is a side view of the cleaning pad shown in FIG. 5 in a "closed" position.

FIGS. 5 and 6 show a cleaning pad 11 which can be removably attached to either retaining means located on the top or the bottom surface of a mop head. In one embodiment, the absorbent layer 21 of the pad can have a width which is greater than the width of a mop head such that a front and back portions of the absorbent layer 21, form a first and a second attachment wing portion 121, 221 of the pad, which are mechanically engageable by attachment structures located on the top surface of a mop head. One skilled in the art will understand that the attachment wing portions 121, 221 of the pad can be an integral part of the absorbent layer but also that the attachment wing portions can be separate layer of material connected to the absorbent layer 21 and still provide the same benefits. In one embodiment, the width of a cleaning pad 11 is at least about 10%, preferably at least about 25%, more preferably at least about 50% and most preferably at least about 100% greater than the width of the mop head. In one embodiment, the width of the cleaning pad is between about 5 cm and about 50 cm, preferably between about 10 cm and about 40 cm, more preferably between about 20 cm and about 35 cm.

In one embodiment, the cleaning pad 11 is mechanically being engaged by retaining means located on the bottom surface of the mop head of the implement. In a preferred embodiment, these retaining means are hook fasteners attached to the bottom surface of the mop head. In one embodiment, the absorbent layer 21 can be made of a fibrous material having grabable fibers which can be engaged and retained by the hook fasteners located at the bottom surface of the mop head.

In another embodiment, the cleaning pad 11 can have at least one, but preferably two strips of mechanical fasteners 31, 41 which can be attached to a surface of the cleaning pad 11, preferably a top surface of the pad which faces the retaining means located on the bottom surface of the mop head. In one embodiment, the strips of mechanical fasteners 31, 41 are strips of loops fasteners. In one embodiment, strips of hook fasteners can also be attached to a surface of a cleaning pad either in addition to or instead of the strips of loops fasteners 31, 41. Among other benefits, strips of hook fasteners allow the pad to be removably attached to loop fasteners attached at the bottom surface of the mop head of an implement.

In one embodiment, the strips of loop fasteners 31, 41 can be attached to the top surface of the cleaning pad 11 as shown in FIGS. 5 and 6. A non-limiting example of loop fasteners 31, 41 include strips of a fibrous material which can be adhesively attached to the absorbent layer 21. Non-limiting examples of suitable loop fasteners include non-woven materials which will be later described. One skilled in the art will understand that the size as well as the location of the strips of loop fasteners 31, 41 on the absorbent layer 21 are related to the location of the hook fasteners at the bottom of a mop head. In this embodiment, the cleaning pad 11 can be removably attached to the mop head of a first cleaning implement having retaining means located on the top surface of the mop head but it can also be removably attached to a second cleaning implement having retaining means located at the bottom surface of the mop head of this second implement.

Cleaning pads can be folded in order to be conveniently packaged. In one embodiment, a cleaning pad 11 can be folded along a first and a second folding line 1121, 1221 such that the attachment wing portions 121, 221, cover at least partially the top surface of the cleaning pad 11 as shown in FIGS. 5 and 6. In this embodiment, the strips of loop fasteners 31, 41 are preferably attached to the top surface of the attachment wing portions 121, 221 of the pad. In a preferred embodiment, the two layers of loop fasteners 31, 41 are substantially adjacent to the folding lines 1121, 1221 (i.e. leading and trailing edges) of the pad 11. One skilled in the art will understand that in this embodiment, the top surface of each attachment wing portion 121, 221 of the pad 11 is the surface of the wings facing substantially upwards when each attachment wing 121, 221 is folded onto the cleaning pad 11. Among other benefits, having the loop fasteners 31, 41 attached to the top surface of each attachment wing portion 121, 221 provides a visual signal to the user who can readily see the attachment wing portion 121, 221 of the pad as well as the strips of loop fasteners. As a result, a user is aware that the cleaning pad is attachable to retaining means located on the top or the bottom surface of a mop head. Another benefit of having the loop fasteners 31, 41 attached to the top surface of each portion 121, 221 of the pad is that a consumer can attach the cleaning pad directly to the bottom surface of a mop head having hook fasteners without having to unfold or "open" the attachment wing portions 121, 221 in order to access the strips of loop fasteners 31, 41. Still another benefit of having the loop fasteners attached to the top surface of each attachment wing portion of the pad is that when such a pad is attached to the hook fasteners located on the bottom surface of a mop head, each attachment wing portion is in direct fluid communication with the middle portion of the pad and, as a result, a greater "volume" of the absorbent layer, and consequently of the cleaning pad, can be used to absorb liquid from a surface.

Figure 7:
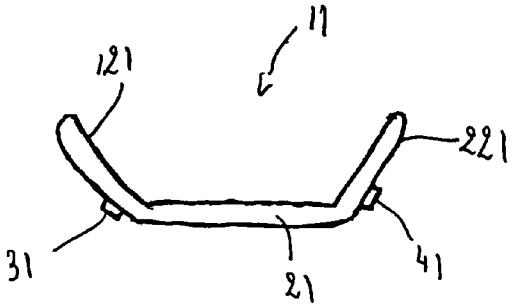
FIG. 7 is a side view of the cleaning pad shown in FIG. 5 in an "open" position.

FIG. 7 shows a cleaning pad 11 in an "opened" position with the attachment wing portions 121, 221 which are attachable to retaining means located on the top surface of a mop head.

Figure 8:
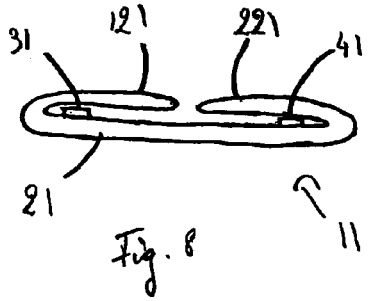
FIG. 8 is a side view of another cleaning pad shown in a "closed" position.
Figure 9:
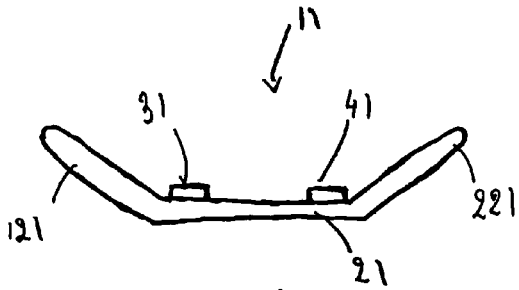
FIG. 9 is a side view of the cleaning pad of FIG. 9 shown in an "open" position.

In one embodiment represented in FIG. 8, the loop fasteners 31, 41 can be attached to the top surface of the absorbent layer 21 such that they are "sandwiched" between the attachment wing portions 121, 221 and the centered portion of the absorbent layer 21. In this embodiment, a user needs to "open" the pad 11 in order to access the strips of loop fasteners 31, 41 to attach the pad to retaining means located on the bottom surface of a mop head, as shown in FIG. 9.

Figure 10:
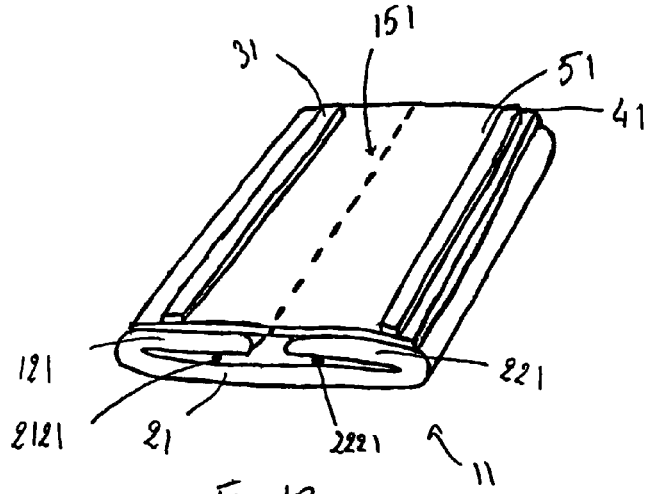
FIG. 10 is an isometric view of one cleaning pad of the invention.
Figure 11:
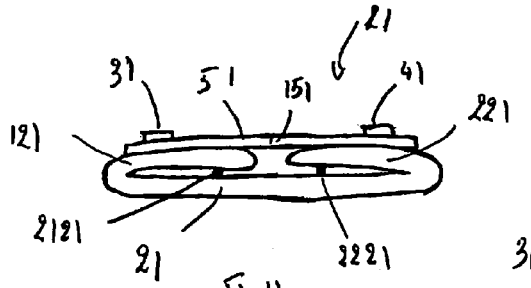
FIG. 11 is a side view of the cleaning pad shown in FIG. 10 in a "closed" position.

In one embodiment represented in FIGS. 10 and 11, a cleaning pad 11 can optionally, but preferably have a barrier layer 51 made of a semi-pervious or substantially impervious material, located on the top of the cleaning pad 11. The barrier layer 51 can be made of any impervious material known in the art, which substantially prevents the passage of a liquid from one side of the barrier layer to the other side of this layer. Non-limiting examples of suitable materials include plastics such as polyethylene, polypropylene, polyester, and similar films. In a preferred embodiment, the impervious layer 51 is made of a clear translucent film of material which allows the user to see the soil which has been absorbed in the absorbent layer(s), especially in the uppermost absorbent layer 21. A clear translucent impervious layer is beneficial to let the user know that it is time to replace the cleaning pad. In addition, a substantially impervious layer 51 can be beneficial to prevent the liquid which is absorbed by the pad 11, from coming in contact with the bottom surface of the mop head.

In one embodiment, the impervious layer 51 can be located on the top surface of the attachment wing portions 121, 221 such that the impervious layer substantially covers the top surface of the two attachment wing portions 121, 221. When a user wishes to use the cleaning pad 11 with a cleaning implement having retaining means located on the top surface of the mop head, the user can simply break, tear or cut this impervious layer such that each attachment wing portion 121, 221 can be attached to the top surface of the mop head. In a preferred embodiment, the impervious layer 51 comprises a perforation line 151 in order to help the user "break" (i.e. separate) the impervious layer 51. One skilled in the art will understand that the same result can be achieved by at least partially bonding two separate impervious layers together. In this embodiment, the strips of loop fasteners 31, 41 are preferably attached to the top surface of the impervious layer 51 such that a user can readily attach the cleaning pad 11 to the bottom surface of a mop head having hook fasteners without having to break the impervious layer 51.

Figure 12:
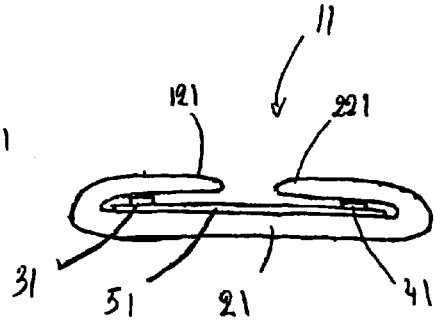
FIG. 12 is a side view of another embodiment shown a "closed" position.

In another embodiment represented in FIG. 12, the impervious layer 51 can be located on the top surface of the absorbent layer 21 such that it is "sandwiched" between the attachment wing portions 121, 221 and the middle portion of the absorbent layer 21. In this embodiment, the strips of loop fasteners 31, 41 can be attached to either the top surface of the attachment wing portions 121, 221 as previously discussed, or to the top surface of the impervious layer 51. In still another embodiment, an impervious layer 51 can be attached to the top surface of each attachment wing portions 121, 221.

In one embodiment, the attachment wing portions 121, 221 can be at least partially attached to the top surface of the cleaning pad 11 such that each attachment wing portions 121, 221 is "tacked down" on the top surface of the cleaning pad. By "at least partially attached" it is meant that the attachment wing portions 121, 221 are partially bonded to the top surface of the absorbent layer 21 and/or the impervious layer 51 but that a user can "separate" each attachment wing portion 121, 221 by breaking these partial bonds 2121, 2221. One skilled in the art will understand that the partial bonds 2121, 2221 can be created via any process know in the art. For example, the partial bonds 2121, 2221 can be created by applying a pressure sensitive adhesive to the top surface of the cleaning pad and then and by folding each attachment wing portion 121, 221 such that these are in contact with the adhesive. Partial bonds 2121, 2221 can also be created by thermo-bonding the attachment wing portions 121, 221 to the top surface of the cleaning pad 11. The partial bonds 2121, 2221 can be formed on any area of the attachment wing portions 121, 221 as long as they are breakable by a user when the user wishes to attach the attachment wing portions 121, 221 to the retaining structures located on the top of a mop head. Among other benefits, it is believed that partial (or frangible) bonds between the attachment wing portions 121, 221 and the top surface of the cleaning pad 11 enhances the structural integrity of the pad. Consequently, the cleaning pad 11 is readily and conveniently attachable to the bottom surface of a mop head having hook fasteners. The partial bonds 2121, 2221 also prevent the attachment wing portions 121, 221 from flipping back and forth when a user wishes to attach the pad to retaining means located on the bottom surface of a mop head.

Figure 13:
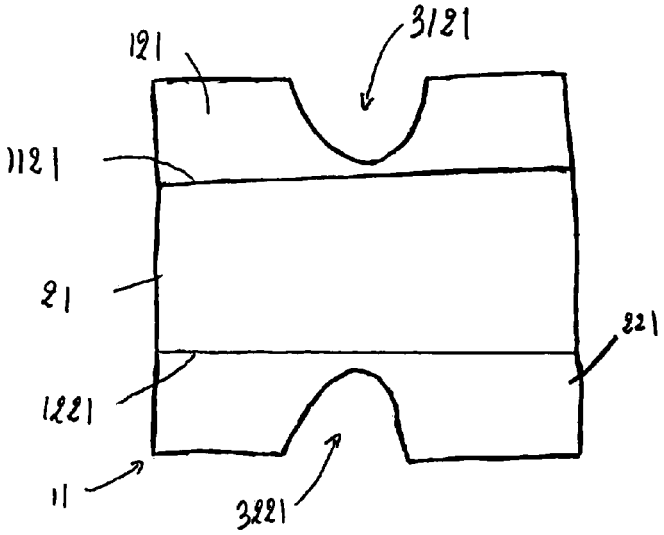
FIG. 13 is a top view of one embodiment shown in an "open" position.

FIG. 13 represents a cleaning pad 11, viewed from the top in an "open" position and which can have at least one notch 3121 made on at least one of the attachment wing portions 121, 221. Among other benefits, a notch 3121 allows the user to attach the pad 11 to the retaining means located on the top surface of a mop head and which comprises a nozzle for delivering a liquid, which is also attached to the top surface of the mop head. One skilled in the art will understand that the attachment wing 121 having a notch 3121 does not block or obstruct the liquid being delivered from the nozzle during the cleaning operation. In a preferred embodiment, both attachment wing portions 121, 221 comprise respectively a notch 3121, 3221 such that the cleaning pad 11 can be attached to the mop head independently of the orientation of the leading edge or trailing edge of the cleaning pad 11. One skilled in the art will also understand that any type of notch can be made to the attachment wing portions 121, 221 as long as it allows the nozzle on the mop head to dispense the cleaning solution onto a hard surface without having the cleaning solution being blocked or obstructed by the cleaning pad.

Figure 14:
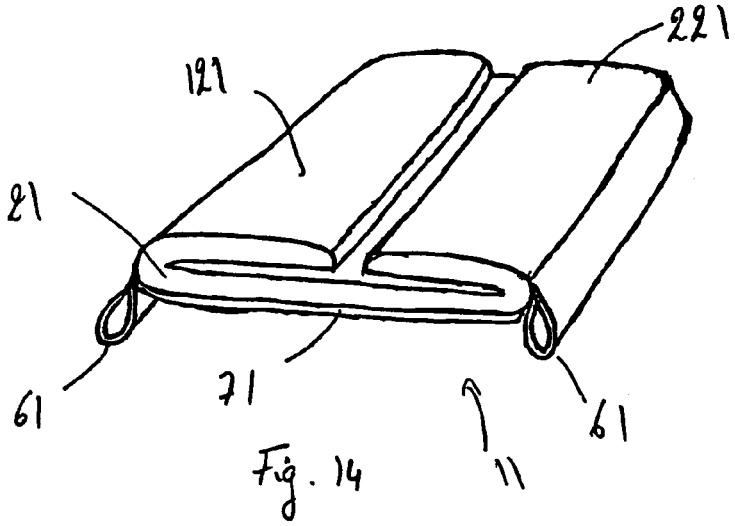
FIG. 14 is an isometric view of one cleaning pad of the invention.

In one embodiment, shown in FIG. 14 a cleaning pad 11 can have one or more cuffs, preferably "free-floating" functional cuffs 61 which can be attached to the leading edge and/or the trailing edge of the cleaning pad 11. The functional cuff(s) 61 improves the cleaning performance of the cleaning pad, for example in terms of particulates being picked-up by the pad. As a cleaning pad comprising functional cuff(s) is wiped back and forth across a hard surface, the functional cuff(s) "flip" from side to side, thus picking-up and trapping particulate matters. The functional cuffs 61 can be either mono-layer cuffs (i.e. made of a single layer of material which is looped) or can be dual-layer cuffs (i.e. two layers of material which are looped together). Non-limiting examples of functional cuffs are described in PCT application Serial No. WO 00/27271 to Policicchio et al, filed Nov. 9, 1999, and in PCT application Serial No. WO 02/41743 to Policicchio, filed Nov. 27, 2001, both assigned to The Procter & Gamble Company.

In one embodiment, a cleaning pad 11 can have a floor sheet 71 that can function as a scrubbing layer. In one embodiment, the floor sheet is in fluid communication with the bottom surface of the absorbent layer 21 of the cleaning pad 11. Non-limiting examples of suitable floor sheets are described in greater details in section V. infra.

Figure 15:
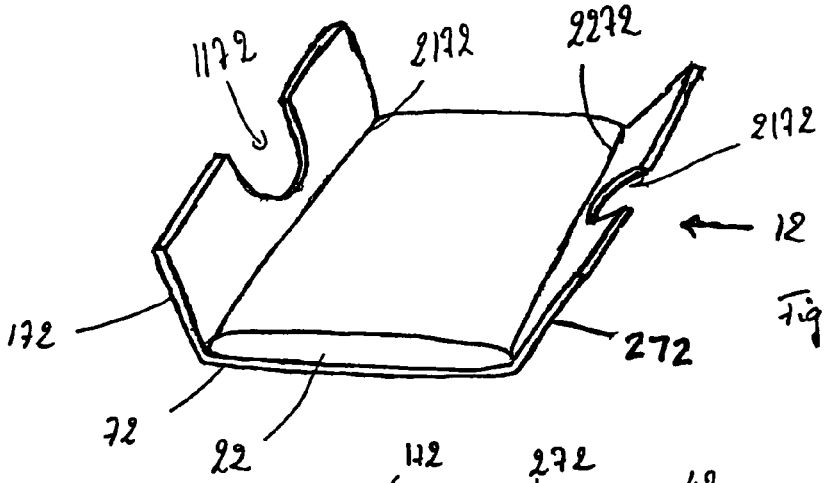
FIG. 15 is an isometric view of one cleaning pad of the invention shown in an "open" position.
Figure 16:
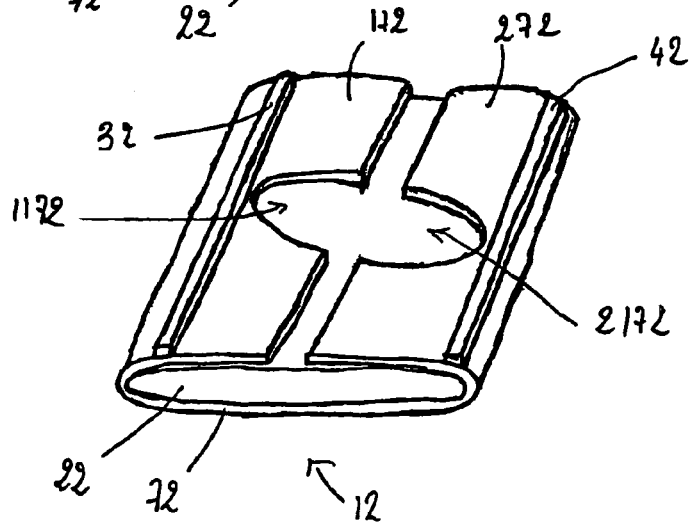
FIG. 16 is an isometric view of one cleaning pad of the invention.

In another embodiment, shown in FIGS. 15 and 16, a cleaning pad 12 can have an absorbent layer 22 and a floor sheet 72 which can have a width greater than the width of the mop head of a cleaning implement such that the floor sheet 72 comprises a first and a second attachment wing portion 172, 272. The first and second attachment wing portions 172, 272 can be removably engaged and retained by retaining means located on the top or bottom of the mop head. As previously discussed, the attachment wing portions 172, 272 of the floor sheet can respectively have a notch 1172, 1272 which allow a liquid to be delivered from a nozzle located on the top of a mop head. In one embodiment, the attachment wing portions 172, 272 of the floor sheet 72 can be made of a loop fastener type material suitable to be removably attached to hook fasteners located at the bottom surface of a map head. In one embodiment, the strips of loop fasteners 32, 42 can be attached to the attachment wing portions 172, 272, preferably to the top surface of the attachment wing portions such that the cleaning pad 12 is removably attachable to hook fasteners located at the bottom surface of a mop head. In one embodiment, the attachment wing portions 172, 272 can be folded onto the top surface of the cleaning pad and form a first and a second folding line 2172, 2272. In one embodiment, the attachment wing portions 172, 272 can be partially bonded to the top surface of the cleaning pad and/or be partially bonded to each other as previously described.

Figure 17:
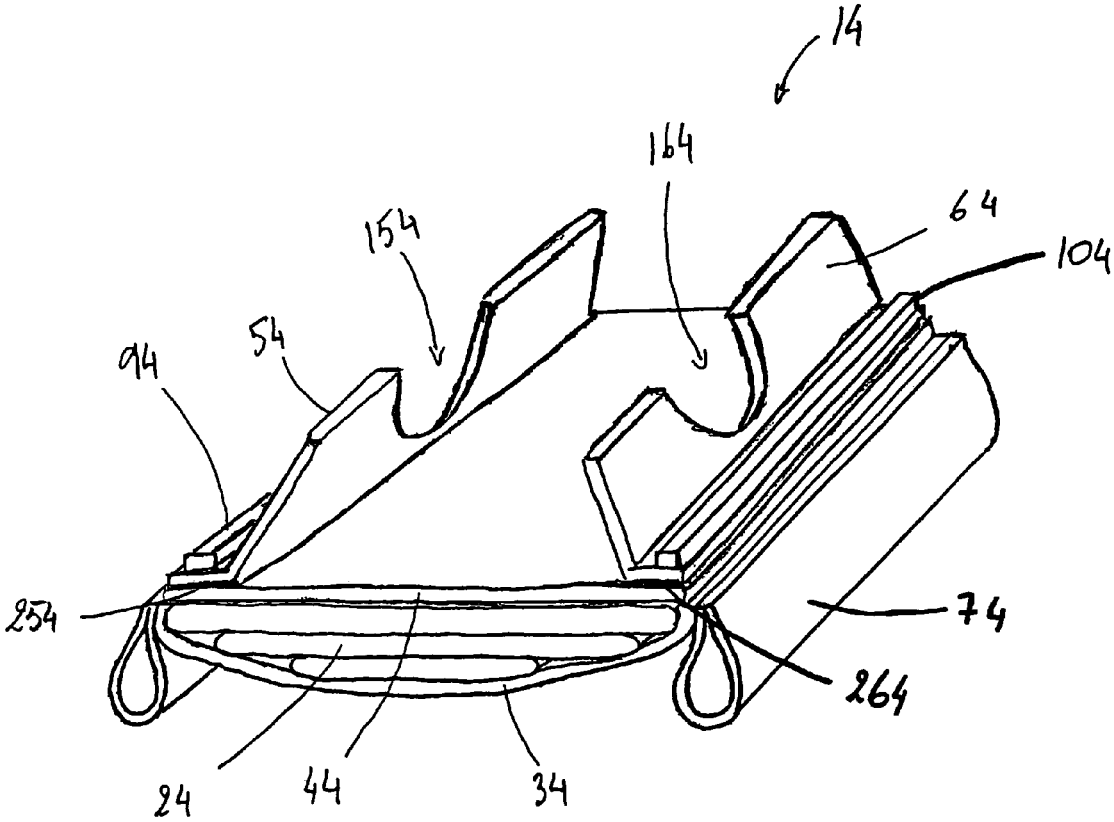
FIG. 17 is an isometric view of one cleaning pad of the invention shown in an "open" position.

In another embodiment shown in FIG. 17, a cleaning pad 14 comprises at least one but preferably multiple absorbent layers 24. In one embodiment, the cleaning pad 14 comprises at least an absorbent layer 24, a floor sheet 34 which is in direct fluid communication with the bottom surface of the absorbent layer 24, a barrier layer 44 which is located on the top of the absorbent layer 24, attachment wings 54, 64 for removably attaching the pad to retaining means located on the top surface of a mop head and, optionally but preferably, at least one functional cuff 74.

The absorbent layer(s) 24 can be made of any of the materials described hereinafter. In one embodiment, the cleaning pad 14 comprises at least two, but preferably at least three absorbent layers 24 which are consecutively in fluid communication and which have different widths such that the overall absorbent core, formed by the multiple absorbent layers 24, has multiple widths along the z axis.

In one embodiment, the barrier layer 44 (or backsheet) can be made from a substantially impervious material such as polyethethlene, polypropylene, polyester, and similar films, or from a semi-pervious material including one or more non-wovens layers such as SMS (spun-bond, melblown spun-bond), spun-bonded, carded, thermal bonded or hydro-entangled in order to keep liquid and dirt that is absorbed contained within the absorbent core of the pad 14 while at the same time helping to keep the bottom of the mop head dry and clean. In one embodiment, the barrier layer 44 can be composed of a single layer or multiple layers. When the cleaning pad 14 is used with a cleaning implement having a built-in fluid delivery mechanism, and in particular when this fluid delivery mechanism tends to dribble liquid onto the back of the pad 14 while the liquid is being delivered, it is beneficial for the barrier layer 44 to be semi-pervious rather than substantially impervious. Without intending to be bound by any theory, it is believed that if some liquid dribbles onto the back of the pad 14 having a barrier layer 44 made of a semi-pervious, this liquid can penetrate through the substantially impervious layer and then be absorbed by the absorbent layer(s) 24. An semi-pervious layer reduces the accumulation of liquid onto the back of the pad, which otherwise could potentially drip onto the floor when a user removes the pad from the mop head. One example of suitable semi-pervious material is an apertured polyethylene film. In one embodiment, apertures can be made to a barrier layer 44, made of either a semi-pervious or substantially impervious material, by cutting holes or slits into the layer. For example, apertures can be made on a polyethylene film which has already been formed or by creating the apertures in the film during its formation. An example of such a process is the vacuum forming technology used by Tredegar Industries.

In one embodiment, the cleaning pad 14 comprises at least a pair of attachment wings 54, 64 which can be attached to one of the layers of the pad 14, preferably the barrier layer 44. The attachment wings 54, 64 can be attached to the barrier layer 44 with an adhesive such as a hotmelt adhesive which can be applied to a defined area of the barrier layer 44, preferably an area adjacent to the leading edge and the trailing edge of the barrier layer 44, in any pattern known in the art such as beads, spirals or slot coating.

In one embodiment, the attachment wings 54, 64 can be made from plastic films, non-wovens, paper or any combination or laminates of these materials. In a preferred embodiment, the attachment wings 54, 64 are made from a material having a good dry strength and a good wet strength. By "dry strength" it is meant that when the material is substantially dry, it does not substantially tear or overly stretch, in particular when the attachment wings 54, 64 are pulled and then mechanically engaged by retaining means located on the top of a mop head. By "wet strength" it is meant that the structural properties of the material do not substantially degrade when the material is wet. A good wet strength is beneficial when a liquid gets in contact accidentally with the attachment wings 54, 64 during a wet mopping operation. It is possible to characterize the type of material used to make the attachment wings 54, 64 by its Machine Direction (herein after "MD") and/or its Cross Direction (hereinafter "CD") properties. One skilled in the art will understand that by "Machine Direction", it is meant the direction in which the greater number of the fibers of a substrate tend to be oriented. The substrate is typically stronger in the machine direction, and also experiences less dimensional variation in the machine direction. By "Cross Direction", it is meant the direction substantially perpendicular to the machine direction. In one embodiment, the attachment wings 54, 64 can be attached to the cleaning pad 14 such that the MD of the material is oriented along the length of the pad (i.e. parallel to the leading/trailing edges of the pad) and the CD of the material is oriented along the width of the pad (i.e. substantially perpendicular to the leading/trailing edges of the pad). Without intending to be bound by any theory, it is believed that in this embodiment, the CD tensile properties are particularly relevant to the tear resistance of the attachment wings 54, 64 since this is the direction in which the attachment wings are stretched and pulled by the user when the user wishes to attach the wings to the retaining means on the top of the mop head. In another embodiment, the attachment wings 54, 64 can be attached to the cleaning pad 14 such that the CD of the material is oriented along the length of the pad (i.e. parallel to the leading/trailing edges of the pad) and the MD of the material is oriented along the width of the pad 14 (i.e. substantially perpendicular to the leading/trailing edges of the pad). In one embodiment the tensile strength of the attachment wing 54, 64 in the direction substantially perpendicular to the leading/trailing edges of the pad 14 is at least about 300 g/inch, preferably at least about 500 g/inch and more preferably at least about 700 g/inch. It is also believed that in order to have the attachment wings 54, 64 being suitably retained by the retaining means, the degree of bulk or the thickness of the material used to make the attachment wings 54, 64 should be carefully chosen. In one embodiment, the material used to make the attachment wings 54, 64 has a thickness of at least about 0.2 mm, preferably at least about 0.25 mm and more preferably at least about 0.3 mm when measured under a 0.1 psi force using a caliper gauge. In addition, it is believed that the stiffness of the attachment wings 54, 64 can impact on the ability of the user to "manipulate" the attachment wings. In one embodiment, the material used to make the attachment wings 54, 64 has a basis weight of at least about 15 g/sqm (or 15 gsm), preferably at least 30 g/sqm (or 30 gsm), and more preferably at least about 40 g/sqm (or 40 gsm). It can also be beneficial that the attachment wings 54, 64 be substantially tear resistant, in particular when a portion of the attachment wings is "tucked" into the deflectable slitted attachment structures or gripper which can have sharp edges. It can also be beneficial that the material used to make the attachment wings 54, 64 have a certain amount of texture or roughness in order for the attachment wings 54, 64 to remain engaged within the retaining structures located on the top of a mop head, in particular during the mopping operation. A "smoother" material having a lower co-efficient of friction can potentially cause the attachment wings 54, 64 to slip out of the retaining means located on the top of a mop head. Non-limiting examples of suitable materials used to make the attachment wings include non-wovens such as spun-bonds, spun-bond melt blown spun-bonds, hydro-entangled and the like. Plastic materials, in the form of films, are typically smoother than non-wovens and tend to be less puncture resistant but can still be used, although not preferred, to make the attachment wings 54, 64. In one embodiment, the attachment wings 54, 64 can be made of a plastic material having a relatively high basis weight of at least about 25 gsm, more preferably about 30 gsm and even more preferably about 40 gsm. The attachment wings 54, 64 can also be made of a film of plastic material which can be laminated to another material. The attachment wings 54, 64 can also be made of a plastic material which can be modified, i.e. made with co-polymers or embossing to reduce the material's smoothness. One possible way to achieve this result is to apply hot melts or the like, to the surface of the film in order to create bulk and/or roughness or also by applying an elastomeric material to the surface of the attachment wings 54, 64. Non-limiting examples of suitable hotmelt adhesives include HL-2238, HL-1461, D-3151 and HL-1620 made by the HB Fuller Company, of St. Paul, Minn., and H2737, H2738, H2736, HX5275-01, HX5258-01, made by Bostik Findley Inc, of Wauwatosa, Wis. In one embodiment, a plastic film can also be deformed or corrugated by ring rolling type technologies which are well known in the art in order to create bulk and/or roughness.

Figure 18:
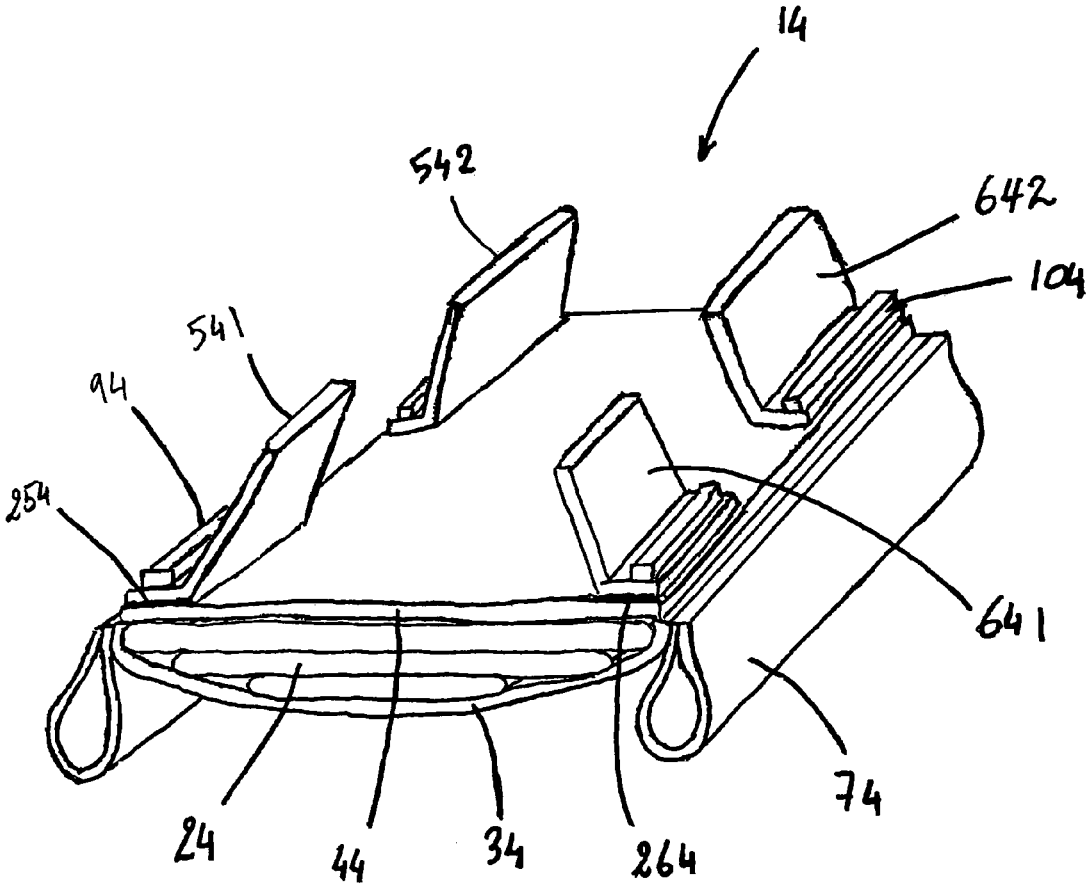
FIG. 18 is an isometric view of another embodiment of the invention shown in an "open" position.

Many of the modern type cleaning implements have a built-in fluid delivery mechanism comprising a nozzle removably or permanently attached to the mop head or the handle of the implement. As previously discussed, it can therefore be beneficial that at least one of the attachment wings 54, 64 have a notch or cut-out 154 as shown in FIG. 17. This notch or cut-out 154 allows the user to attach the cleaning pad to the mop head of an implement having a nozzle located on the top of the mop head while allowing a liquid to be delivered from the nozzle without being blocked or obstructed by the attachment wing 54. In a preferred embodiment, a cleaning pad 14 comprises a pair of attachment wings 54, 64 each having a notch or cut-out 154, 164 such that a user can attach the cleaning pad to the mop head independently of the orientation of the leading edge or trailing edge of the pad 14. One skilled in the art will understand that instead of having an attachment wing 54, 64 made of a continuous layer of material with a notch 154, 164, the same result can be achieved by providing a cleaning pad with four separate attachment wings 541, 542, 641 and 642, attached by pair on each side of the pad, i.e. on the leading edge and/or the trailing edge of the pad such that there is a space in between these two separate attachment wings located on a same edge as shown in FIG. 18.

Figure 19A:
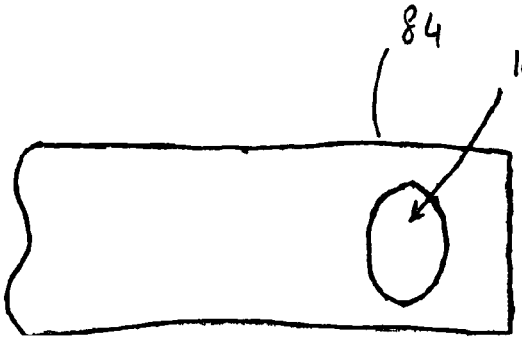
FIG. 19*a* is schematic representation of the first step of one process of making the invention.
Figure 19B:
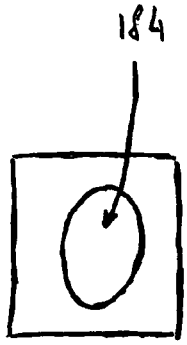
FIG. 19*b* is schematic representation of the second step of one process of making the invention.
Figure 19C:
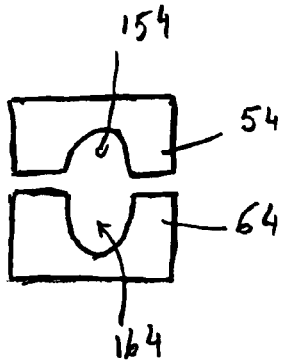
FIG. 19*c* is schematic representation of the third step of one process of making the invention.

In one embodiment, the notch 154 can be made by cutting out a substantially centered section of an attachment wing 54. In one embodiment, the attachment wings 54, 64 each having a notch 154, 164 can be made by providing a layer or web of material 84 from a roll of material and by subjecting this layer to a knife which punches out a preferably symmetrical centered notch 184 as shown in FIG. 19*a*. The portion of material which has been cut out from the continuous web of material 84, is then immediately removed from the web using a vacuum. At this point of the process, the layer (web) of material 84 is still in one piece but for the centered portion which has been removed. The layer of material can then be cut along its with and slit in the middle in order to create the two separate attachment wings 54, 64 as shown in FIGS. 19*b* and 19*c*.

Figure 20A:
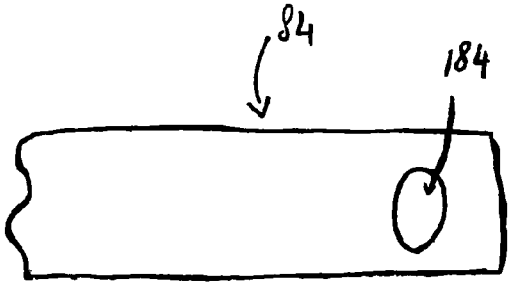
FIG. 20*a* is schematic representation of the first step of another process of making the invention.
Figure 20B:
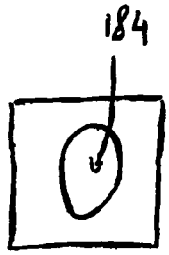
FIG. 20*b* is schematic representation of the second step of another process of making the invention.
Figure 20C:
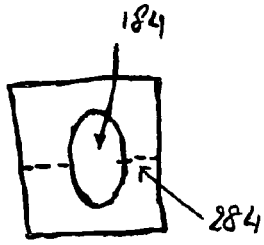
FIG. 20*c* is schematic representation of the third step of another process of making the invention.

In a preferred embodiment represented in FIGS. 20*a* through 20*c*, the layer of material 84 is only partially cut in the middle with for example a perforation blade in order to create a perforation line 284 defining the outer edges of the attachment wings 54, 64 while maintaining the integrity of the layer of material 84. Preserving the layer's integrity can simplify the manufacturing process since a single layer of material 84 can be tracked more uniformly relative to the rest of the pad. The perforations of the centered perforation line 284 can all have the same size or can vary in length or can also include a succession of short perforations followed by a long perforation. As previously discussed, the perforation line 284 allows a user to separate the wings easily along a substantially continuous line before attaching to implement head.

Figure 21A:
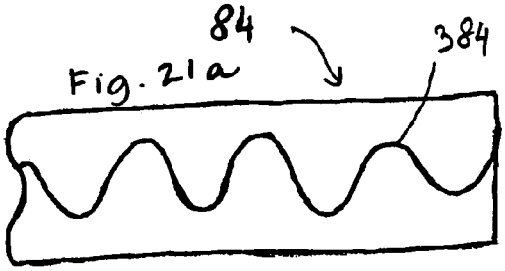
FIG. 21*a* is schematic representation of the first step of another process of making the invention.
Figure 21B:
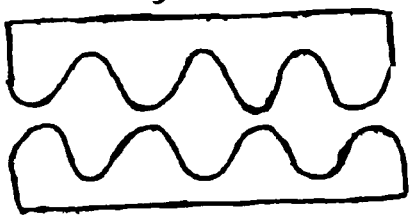
FIG. 21*b* is schematic representation of the first second of another process of making the invention.
Figure 21C:
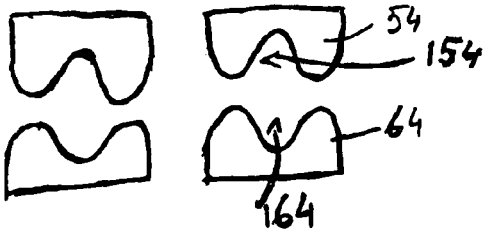
FIG. 21*c* is schematic representation of the third step of another process of making the invention.

In another embodiment represented in FIGS. 21*a* through 21*c*, the attachment wings 54, 64 can be made via a "nesting" process. During the "nesting" process, a symmetrical and periodical shape 384 is cut through a web of material 84 as shown in FIG. 21*a*. The two layers of material obtained, and which ultimately form the attachment wings 54, 64, can then be aligned as shown in FIG. 21*b*. The two separate layers 54, 64 can be aligned, for example by increasing the speed of one them relative to the other. Once the two separate layers are properly aligned, these can be cut along their width to form a pair of attachment wings 54, 64 as shown in FIG. 21*c*. Among other benefits, the "nesting" process reduces the amount of material being wasted as previously described when a notch 184 is cut in a centered area of a layer but it also simplifies the manufacturing process of the cleaning pad 14. The shape can be any symmetrical shape as long as it provides the notches 154, 164 which allow a liquid to be delivered from a nozzle without being blocked by the attachment wing 54 or 64. Non-limiting examples of suitable shapes include sinusoidal, triangular, rectangular or any combination thereof.

In one embodiment, once the attachment wings 54, 64 have been cut, and optionally but preferably notched, these are bonded onto a pad 14. The attachment wings 54, 64 can be bonded to the pad 14 via any process known in the art. Non-limiting examples of suitable bonding processes include adhesive bonding, heat sealing, mechanical crimping, ultrasonic welding and the like.

Figure 22:
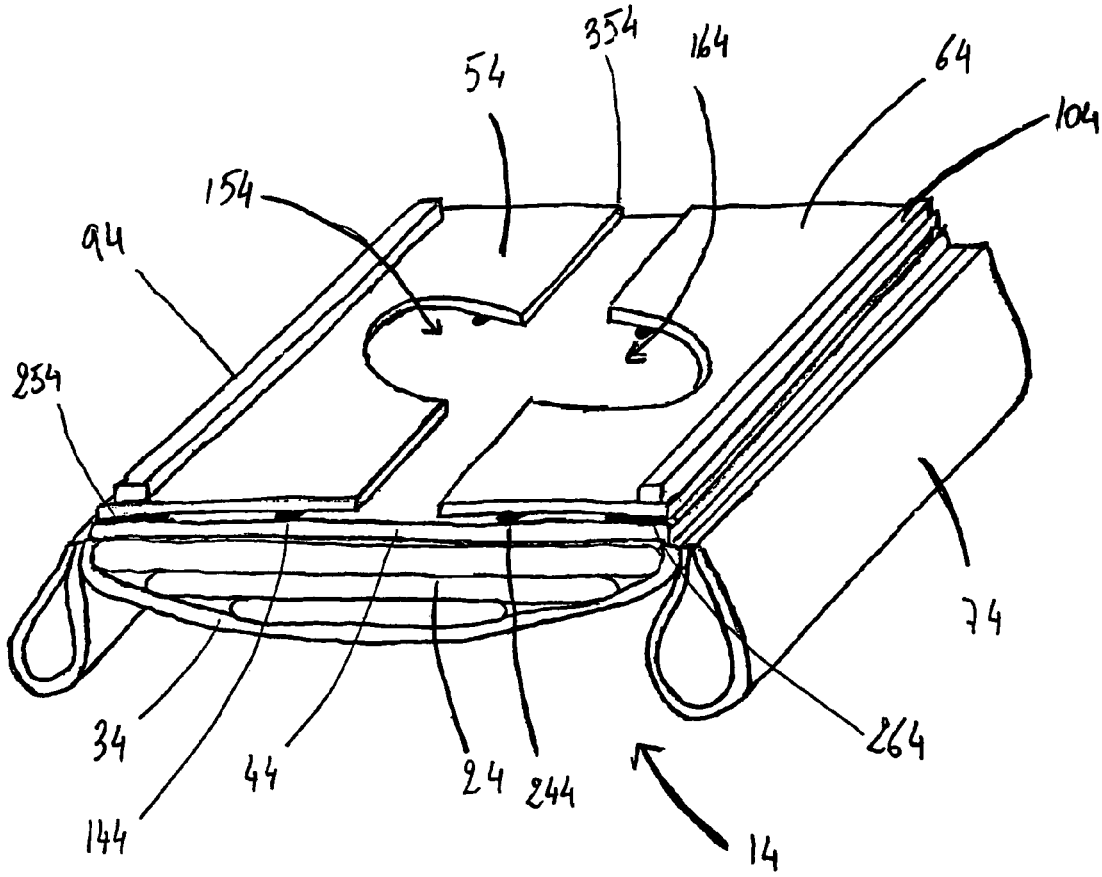
FIG. 22 is an isometric view of one cleaning pad of the invention.
Figure 23:
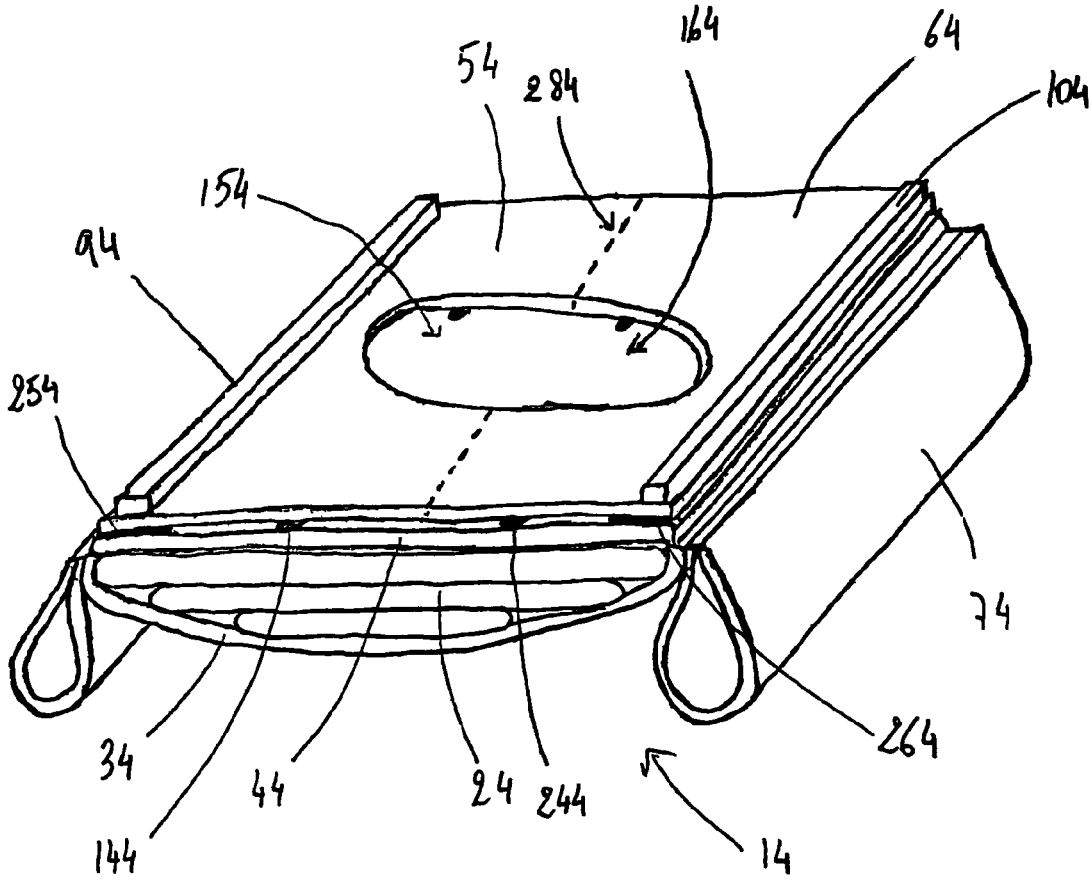
FIG. 23 is an isometric view of another cleaning pad of the invention.

In one embodiment shown in FIG. 22, each attachment wing 54, 64 can be bonded respectively to a first and a second area 254, 264 which can be substantially adjacent to the leading and trailing edges of the pad. In a preferred embodiment the attachment wings 54, 64 are respectively bonded to the areas 254, 264 with glue beads which provide a suitable bond strength. In one embodiment, each bonding area 254, 264 has a width between about 1 mm and about 15 mm. One skilled in the art will understand that when a pad 14 has a fixed width W, the smaller the width of each bonding area 254, 264, the greater the distance between the two attachment wings 54, 64 can be. Optimizing the distance between two attachment wings 54, 64 is particularly beneficial when a cleaning pad is used with a cleaning implement having a wider mop head. As previously discussed, other types of bonding processes can be used to bond the attachment wings 54, 64 to the cleaning pad and provide a suitable bond strength while optimizing the distance between two attachment wings. For example, the attachment wings 54, 64 can be thermo-bonded to the barrier layer of the cleaning pad but in this case, the materials used to make the attachment wings and the barrier layer should be chosen depending on their bonding compatibility In one embodiment shown in FIGS. 22 and 23, the attachment wings 54, 64 can optionally but preferably be partially bonded to the barrier layer 44 of the cleaning pad in addition to being bonded to the leading edge and trailing edge of the barrier layer 44. Each attachment wing 54, 64 can be partially bonded respectively to an area of the barrier layer 44 in order to form partial bonds 144, 244 and such that each attachment wing 54, 64 is "tacked down" onto the top surface of the barrier layer 44. The partial bonds 144, 244 prevent each attachment wing from sliding against the top surface of the barrier layer and keep them in place until a user "breaks" the partial bonds 144, 244 by pulling on the attachment wings 54, 64. Without intending to be bound by any theory, it is believed that when a cleaning pad 14 is attached to the bottom surface of a mop head having hook fasteners, the partial bonds 144, 244 minimize the risk that the cleaning pad 14 would be removed from the mop head due to shear forces exerted on the pad during the mopping operation and in particular when the absorbent layer(s) 24 of the pad increasingly absorbs a liquid. The partial bonds 144, 244 also contribute to distribute homogeneously the shear forces exerted on the pad 14 to a wider portion of the loop fastener and, as a result, the partial bonds 144, 244 avoid a concentration of the shear strength to a local area of the loop fasteners. The partial bonds 144, 244 are preferably easily frangible or "breakable" by a user when a user pulls or peels the attachment wings 54, 64 in order to attach the cleaning pad to retaining means located on the top of a mop head. Suitable partial bonds 144, 244 can be made via any process known in the art. Non-limiting examples of suitable processes include adhesive bonding, heat sealing, mechanical crimping, ultrasonic welding and the like. In one embodiment, the partial bonds 144, 244 are formed by applying a low level of a hotmelt adhesive to a small area of the top surface of the barrier layer 44 which is preferably not greater than about 36 $mm^2$ in order to create a spot weld.

In one embodiment, a partial bond 144 can be located anywhere between the bonding area 254 and the loose edge 354 of an attachment wing 54. In a preferred embodiment, the distance between the bonding area 254 and a partial bond 144 is between about ⅕ and about ⅘, preferably between about ⅓ and ⅔ and more preferably about ½ the distance between the bonding area 254 and the loose edge 354 of the attachment wing 54. Among other benefits, leaving a loose edge 354 "unbonded" allows a user to grab the edge 354 of the attachment wing 54 and pull on the attachment wing 54 in order to break the partial bond 144. One skilled in the art will understand that the size, location and bonding strength of the partial bond 144 can be adapted while still providing the same benefits.

In one embodiment, the bond strength of the partial bond, based on maximum peak force, is between about 30 g/inch width and about 300 g/inch width, preferably between about 30 g/inch width and about 200 g/inch width and more preferably between about 30 g/inch width and about 200 g/inch width. The maximum peak force of the partial bond can be measured by following the ASTM test D 1876-95 (Standard Test Method for Peel Resistance also known as T-Peel Test). In a preferred embodiment, neither the attachment wing (or attachment wing portion) nor the barrier layer (or absorbent layer if no barrier layer is present) are substantially damaged, i.e. torn, when a user peels an attachment wing (or attachment wing portion) and "break" the partial bond. One skilled in the art will understand that the partial bond strength can be adjusted depending on the dry weight of the cleaning pad and the total absorbent capacity of the pad such that the partial bond is not broken due to the pad's weight. By "total absorbent capacity", it is meant the total amount of deionized water that can be absorbed by the pad. One skilled in the art will also appreciate that the amount of shear force exerted to the pad during the cleaning operation preferably do not cause the partial bond to break.

Figure 24:
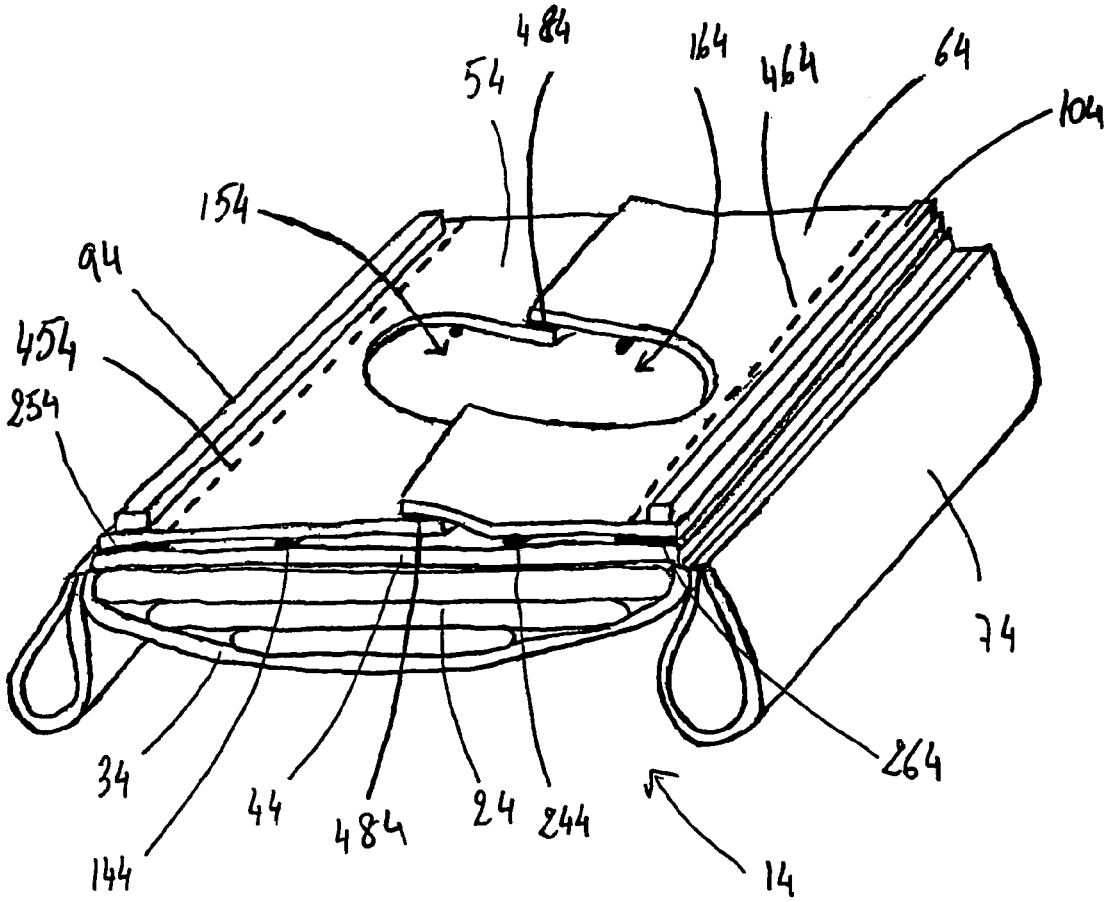
FIG. 24 is an isometric view of another cleaning pad of the invention.

In one embodiment, the attachment wings 54, 64 which are bonded adjacent to the leading edge and trailing edge of the pad 14, can be partially bonded to each other as shown in FIG. 24. The attachment wings 54, 64 can be partially bonded to each other either by creating at least one partial bond 484 between two separate and opposite wings as previously discussed or by having at least a perforation line 284 (shown in FIG. 23) located substantially at the center of a layer of material and which can be broken by a user to create the attachment wings 54, 64 as previously described. A partial bond between the attachment wings 54, 64 improves the "retainability" of a cleaning pad to the bottom surface of a mop head having hook fasteners. A partial bond 484 between the attachment wings 54, 64 is particularly valuable when each attachment wing is not partially bonded to the top surface of the cleaning pad and/or when strips of loop fasteners 94, 104 are located on the top of each attachment wings 54, 64, especially when the strips of loops fasteners 94, 104 are located away from the bonding area 254, 264.

As previously discussed, the cleaning pad 14 of the present invention can be used with either a cleaning implement having retaining means located on the top of a mop head or a cleaning implement having retaining means located at the bottom of the mop head. Typically, retaining means located on the bottom of a mop head are hook fasteners having hook protrusions suitable for mechanically engaging and retaining the grabable fibers of loop materials. Consequently, the "retainability" of a cleaning pad on the bottom surface of a mop head having hook fasteners can be influenced by the type of loop material present on the cleaning pad. In one embodiment, strips of loop fasteners 94, 104 can be added to a cleaning pad 14, preferably to a surface of the cleaning pad which is directly or indirectly accessible by the hook fasteners of a mop head. Non-limiting examples of suitable loop fasteners include XPL-99139 available from 3M Corp., Series 800, 804, and 040 loops from Aplix Corp., Series 1000 and 2000 from Velcro USA Inc. As previously discussed, strips of loop fasteners 94, 104 are preferably added to an outer (or top) surface of the cleaning pad 14 which is directly accessible and engageable by the hook fasteners of a mop head without requiring a user to pull the attachment wings 54, 64. In this configuration, a user can simply apply the top surface of the cleaning pad against the bottom surface of the mop head having hook fasteners in order attach the pad to the implement. In one embodiment, strips of loop fasteners 94, 104 can be added to the top surface of the barrier layer 44 (or absorbent layer 24 if no barrier layer is used) such that the strips of loop fasteners are "sandwiched" between the attachment wings 54, 64 and the barrier layer 44. In one embodiment, the attachment wings 54, 64 can be made of the same type of material as the functional cuffs previously described. Among other benefits, not only these attachment wings 54, 64 are removably attachable to a cleaning implement having retaining means on the top surface of the mop head, but also provide the same benefits as the functional cuffs 74 when the pad 14 is used with a cleaning implement having hook fasteners. When the cleaning pad is used with an implement having hook fasteners at the bottom of the mop head, the "unused" portion of the attachment wings 54, 64 can extend outwardly and downwardly such that they can contact the floor surface during a typical mopping operation.

In one embodiment, each attachment wing 54, 64 can optionally have respectively a perforation line 454, 464 which is substantially adjacent to the bonding areas 254, 264 such that a user can optionally remove the attachment wings 54, 64 from the pad 14. This can be the case when the attachment wings 54, 64 are not needed for retaining a pad about the mop head of an implement having hook fasteners.

As previously discussed, strips of loop fasteners 94, 104 can be attached to either the top surface of the barrier layer 44 or the top surface of the attachment wings 54, 64. Many loop fastener type materials can be viewed as "optimized" in the sense that they are specifically designed to be engaged by and removed from hook fasteners materials several times while maintaining good retainability properties. By "optimized loop material", it is meant a material having a Peel Force greater than about 200 g when measured with the Peel Force Test which is described in greater details hereinafter. However, a cleaning pad 14 which is used with cleaning implements having hook fasteners is only attached to and removed from the mop head a relatively small number of times before the pad is used and disposed of. Consequently, an "optimized" loop material may not be needed to allow a pad 14 to be retained to hook fasteners located on the bottom surface of a mop head. In addition, "optimized" loop type materials can be rather costly. In order to minimize the manufacturing cost of a cleaning pad while providing a suitable pad which can be used with different types of cleaning implements, a cleaning pad 14 can comprise relatively small strips of "optimized" loop materials. By "acceptable retainability properties" it is meant that a cleaning pad 14 should substantially remain attached to a mop head having hooks fasteners during the mopping operation and/or remain substantially attached to the mop head when the mop head is lifted from the floor surface. In one embodiment, a cleaning pad 14 comprises a least two strips 94, 104 of "optimized" loop material, each having an area of at least about 100 $mm^2$, preferably at least about 250 $mm^2$, and more preferably at least about 500 $mm^2$.

Surprisingly, it was found that for a specific applications such as, cleaning pads attached to the hook fasteners of a mop head, other types of loop materials can be used and still provide the same benefits as the "optimized" type loop fasteners. In one embodiment, a cleaning pad 14 can include attachment wings 54, 64 made of a loop fastener material made of a non-wovens material having a suitable degree of grabable fibers, bulk and/or thickness. It was discovered that the ability of a loop fastener type material to be retained by hook fasteners and, consequently, the ability of a cleaning pad to stay attached to a mop head, can decrease if a liquid is absorbed by the loop fastener type material. Synthetic fibers are substantially hydrophobic and, consequently, do not substantially absorb liquids. In a preferred embodiment, the loop fasteners can be made from non-woven materials comprising synthetic fibers which can be in the form of a mono-layer or multi-layer type material. In one embodiment, a cleaning pad 14 can have further include strips of non-woven loop type material 94, 104 attached to the attachment wings 54, 64 or the barrier layer 44 as previously discussed. When additional strips of loop fasteners 94, 104 are added to a cleaning pad, the attachment wings 54, 64 can be made of a material of a material having a Peel Force of more than about 30 g, but the attachment wings 54, 64 are preferably made of a material having a Peel Force of less than about 30 g.

Figure 25:
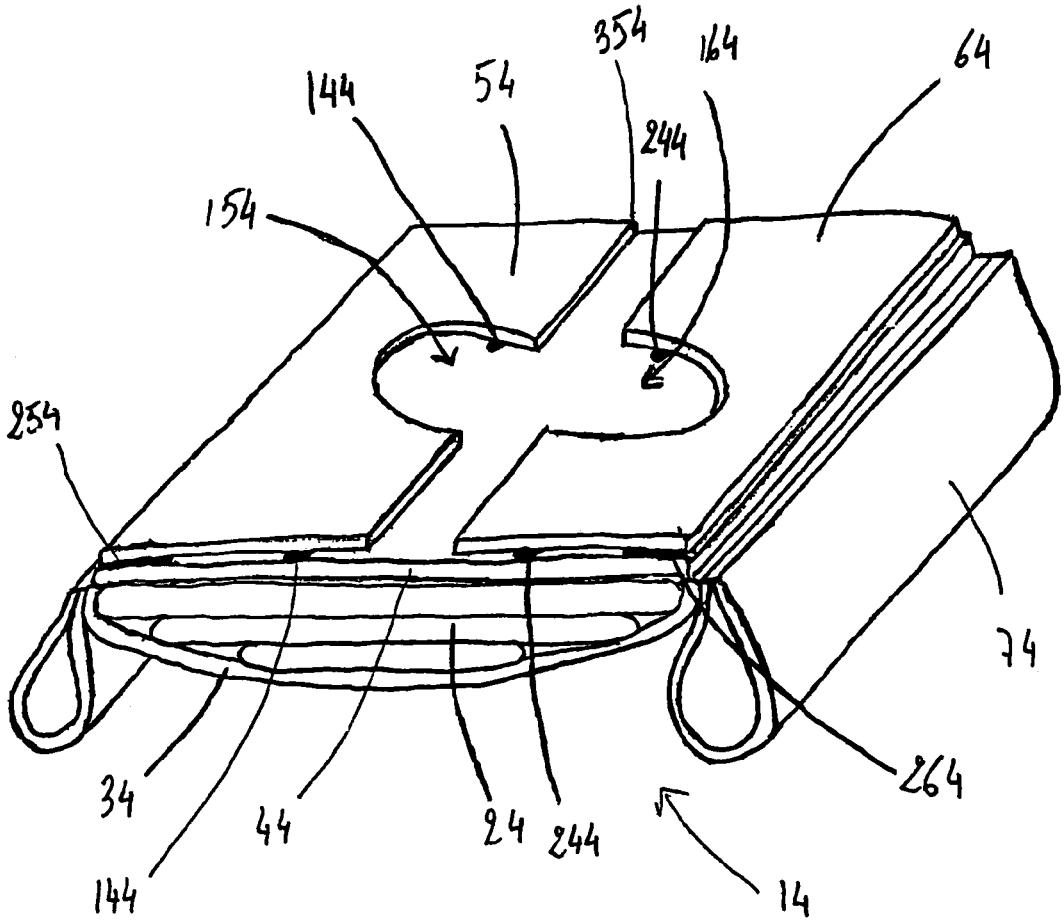
FIG. 25 is an isometric view of another cleaning pad of the invention.

In one embodiment shown in FIG. 25, a cleaning pad 14 can have attachment wings 54, 64 entirely made of a non-woven loop fastener type material. Among other benefits, the use of a non-woven loop type material to make the attachment wings 54, 64, simplifies the manufacturing process of the cleaning pad since additional strips of loop fasteners are not needed. As previously discussed, the thickness of the attachment wings 54, 64, which is related to the degree of bulk, can impact on the ability of the attachment wings 54, 64 to be retained by the attachment structures located on the top of the mop head. The thickness of the attachment wings 54, 64 can also impact on the degree of stiffness of the attachment wings and, as a result, on the user's ability to "open" (or pull) the attachment wings and then attach the cleaning pad 14 to the mop head. In addition, attachment wings 54, 64 made of thicker/stiffer materials can have a tendency to return (or spring back) to their original folded shape. This tendency to return to their original folded and/or unfolded shape may not be well accepted by a user. On the other hand, attachment wings 54, 64 made of thinner are easier to open by a user and do not have the same tendency to return to their original folded and/or unfolded shape once opened by a user. The advantages offered by thinner attachment wings 54, 64 must be balanced against their relatively poor tear resistance and low degree of bulk, in particular when the attachment wings 54, 64 are attached to sharp slitted structures. In order to offer the advantages of the thinner attachment wings while trying to limit their relative weakness from a consumer point of view, a cleaning pad can comprise attachment wings 54, 64 having a width greater than about 50% of the width of the cleaning pad 14 such that the attachment wings 54, 64 overlap on the centered portion 474 of the pad as shown in FIG. 24. One skilled in the art will understand that by increasing the width of the attachment wings 54, 64, it becomes possible to insert more material within each slitted attachment structures of the mop head and, as a result, increase the bulk and/or retainability of the cleaning pad 14 on the mop head. In one embodiment, at least a portion 554, 564 of the attachment wings 54, 64, preferably the portion of the attachment wings which is engaged by the attachment structures of the mop head, has an overall thickness which is greater than the thickness of the remainder of the attachment wing 54, 64.

In one embodiment, a layer of material can be bonded to a portion of each attachment wings 54, 64 in order to increase the thickness of this portion.

Figure 26:
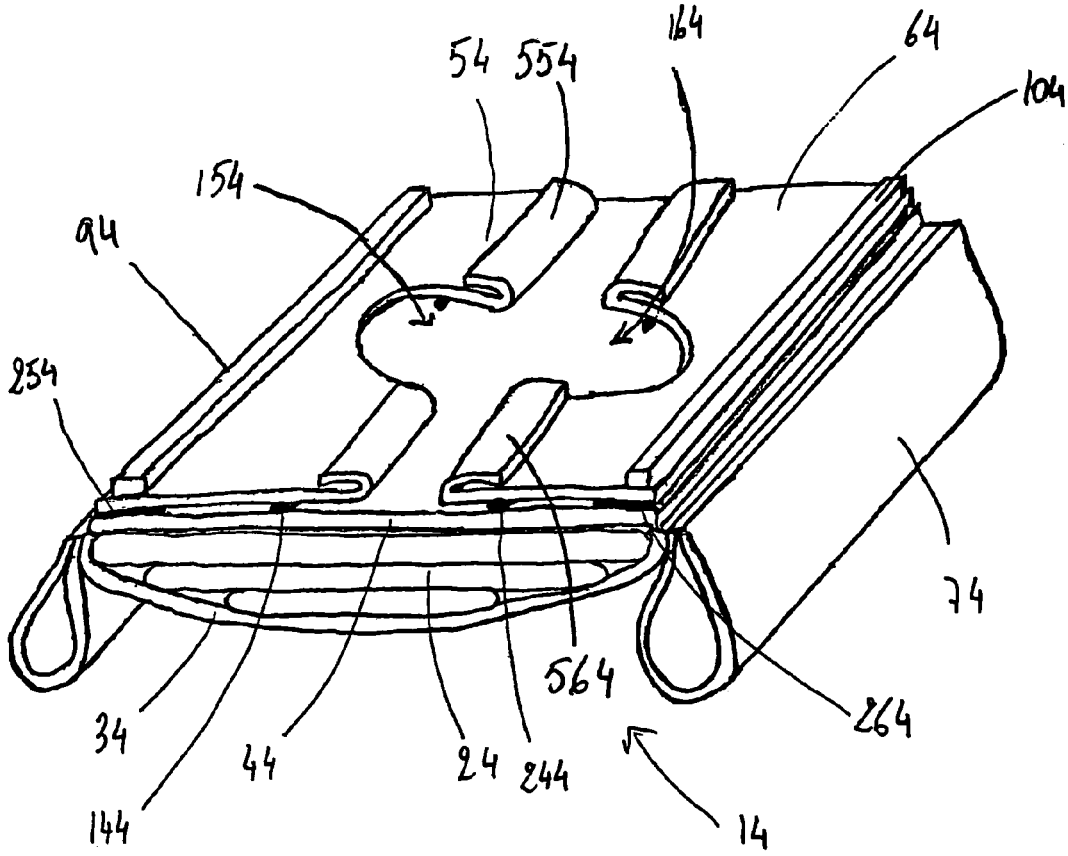
FIG. 26 is an isometric view of another cleaning pad of the invention.

In another embodiment shown in FIG. 26, a portion of the layer of material used to make the attachment wings 54, 64 can be folded (or "looped") and bonded along its length in order to increase, i.e. double, the thickness of the attachment wing 54, 64. In yet another embodiment, each attachment wing 54, 64 can be made of at least two juxtaposed layers of material. Among other benefits, increasing the thickness of at least a portion of each attachment wing 54, 64 can enhance the retainability of this portion of the attachment wings to slitted attachment structures. Increasing the thickness of at least a portion of the attachment wings also enhances the retainability of the attachment wings to the hook fasteners at the bottom surface of a mop head.

IV. Test Method

Suitable non-woven or non-woven laminates materials, which can be used as loop type fasteners, are identified with the following tests. These tests are aimed at recreating the usage conditions of a cleaning pad in both a dry and wet environment as well as determining the peel force of suitable loop fasteners materials.

"Dry" and "Wet" Tests:

During the "dry" and "wet" tests, various non-woven materials are used to make attachment wings or strips of loop fasteners which are attached to a cleaning pad identical to the SWIFFER WETJET® cleaning pad sold by The Procter & Gamble Company. In addition, other commercially available cleaning pads such as the Readymop® cleaning pad, sold by The Clorox Company as well as the GoMop™ cleaning pad, sold by the S.C. Johnson Company, are tested as well.

The first test is performed to evaluate the retainability of a substantially dry cleaning pad to the hook fasteners at the bottom surface of the mop head of a SWIFFER WETJET® cleaning implement.

The second test is performed to evaluate the retainability of a cleaning pad which has absorbed about 100 ml of deionized water, to the hook fasteners at the bottom surface of the mop head of a SWIFFER WETJET® cleaning implement.

These two test were perfomed as follows:

Substantially Dry Pad Attachment Test:

Several cleaning pads are placed such that their bottom surface is laying flat on a vinyl floor surface measuring about 3 ft by 3 ft. A SWIFFER WETJET® cleaning implement having hook fasteners at the bottom surface of the mop head is then carefully applied against the top of the cleaning pads top surface such that the cleaning pad is substantially aligned with the bottom surface of the mop head. A firm pressure of about 0.5 psi is applied downwardly on the handle of the cleaning implement for approximately 3 seconds. The pad is then wiped against the floor surface, in forward and backward motion for 6 swipes while also moving the mop head from the left to the right. The same motion is repeated from the right to the left. The pressure applied to the handle of the cleaning implement used during the wiping motion is approximately 0.25 psi. The mop head of the implement is then lifted off the floor surface and raised approximately from about 12 inches off the floor. If the cleaning pad remains substantially attached to the mop head, it is recorded that this cleaning pad passes the "dry test." If the cleaning pad drops from the mop head, it is recorded that this cleaning pad fails the "dry test."

Substantially Wet Pad Attachment Test:

Each pad of the previous test is then placed on a bench such that the bottom surface of the pad is facing upwards. 100 milliliters of a deionized water is then poured evenly onto each pad. Each cleaning pad is left on the bench for approximately 1 minute in order to let deionized water evenly penetrate into the pad.

As previously described in the "dry test", each cleaning pad is placed such that its floor sheet is laying flat on the same vinyl floor surface. A SWIFFER WETJET® cleaning implement is then carefully applied against the top of the cleaning pad back such that the cleaning pad is substantially aligned with the bottom surface of the mop head. A firm pressure of about 0.5 psi is applied downwardly on the handle of the cleaning implement for approximately 3 seconds. The pad is then wiped against the floor surface, in forward and backward motion for 6 swipes moving from the left to the right. The same motion is repeated from the right to the left. The pressure applied to the handle of the cleaning implement used during the wiping motion is approximately 0.25 psi. The mop head of the implement is then lifted off the floor surface and raised approximately from about 12 inches off the floor. If the cleaning pad remains substantially attached to the mop head, it is recorded that this cleaning pad passes the "wet test." If the cleaning pad drops from the mop head, it is recorded that this cleaning pad fails the "wet test."

TABLE 1

| Example | Type of Cleaning Pad | Wing Material | Wing Configuration | Wings partially bonded to the pad | Loop fasteners or Extra Strip Added | Attachment Pass/Fail |
|---|---|---|---|---|---|---|
| | | | "Dry test" and "Wet test" results | | | |
| I Commercially available no modification | Clorox Ready mop | 70 gsm apertured spun-lace 70:30 Rayon:PET-0.75 mm thick | Uniform separated wings + Notch | No | No | Dry - Fail Wet - Fail |
| II Commercially available no modification | Grab-it Go Mop | 250 gsm core embossed onto 15 gsm spun-bond, 3.4 mm thick | Uniform separated wings without Notch | No | No | Dry - Fail Wet - Fail |
| III Commercially available no | WETJET | None | None | No | Yes - 3M loops 15 mm wide × 1.4 mm thick | Dry - Pass Wet - Pass |

TABLE 1-continued

| Example | Type of Cleaning Pad | Wing Material | Wing Configuration | Wings partially bonded to the pad | Loop fasteners or Extra Strip Added | Attachment Pass/Fail |
|---|---|---|---|---|---|---|
| modification | | | | | | |
| | | Modified Cleaning Pads having Single layer Material to make attachment wings | | | | |
| 1 | WETJET | 40 gsm spun-bond, 100% Polypropylene, 0.35 mm thick | Notched + 12 mm overlap at center wings separated | No | None | Dry - Pass Wet - Fail |
| 2 | WETJET | 40 gsm spun-bond, 100% Polypropylene, 0.35 mm thick | Notched + 12 mm overlap at center wings separated | Yes | None | Dry - Pass Wet - Pass |
| 3 | WETJET | 40 gsm spun-bond, 100% Polypropylene, 0.35 mm thick | Notched + perforation line keeping attachment wings partially attached | No | None | Dry - Pass Wet - Pass |
| 4 | WETJET | 20 gsm spun-bond, 100% Polypropylene, 0.21 mm thick | Notched + 12 mm overlap at center, wings separated | No | None | Dry - Pass Wet - Fail |
| 5 | WETJET | 20 gsm spun-bond, 100% Polypropylene, 0.21 mm thick | Notched + 25 mm fold-over at center, wings separated | Yes | None | Dry - Pass Wet - Pass |
| 6 | WETJET | 20 gsm spun-bond, 100% Polypropylene, 0.21 mm thick | Notched + perforation line keeping attachment wings partially attached | No | None | Dry - Pass Wet - Fail |
| 7 | WETJET | 20 gsm spun-bond, 100% Polypropylene, 0.21 mm thick | Notched + perforation line keeping attachment wings partially attached | Yes | None | Dry - Pass Wet - Pass |
| 8 | WETJET | 60 gsm spun-bond-meltblown-spun-bond, 100% Polypropylene, 0.58 mm thick | Notched + perforation line keeping attachment wings partially attached | Yes | None | Dry - Pass Wet - Fail |
| 9 | WETJET | 30 gsm spun-bond-meltblown-spun-bond, 100% Polypropylene, 0.27 mm thick | Notched + perforation line keeping attachment wings partially attached | Yes | None | Dry - Pass Wet - Fail |
| 10 | WETJET | 20 gsm spun-bond-meltblown-spun-bond, 100% Polypropylene, 0.21 mm thick | Notched + perforation line keeping attachment wings partially attached | Yes | None | Dry - Pass Wet - Pass |
| | | Modified pads having Material For Attachment Wing and additional strip of Material for Attachment to hook fasteners | | | | |
| 11 | WETJET | 20 gsm spun-bond, 100% Polypropylene, 0.21 mm thick | Notched + 12 mm overlap at center, wings separated | No | Yes - 3M loops 15 mm wide × 1.4 mm thick | Dry - Pass Wet - Pass |
| 12 | WETJET | 20 gsm spun-bond, 100% Polypropylene, 0.21 mm thick | Notched + perforation line keeping attachment wings partially attached | No | Yes - 3M loops 15 mm wide × 1.4 mm thick | Dry - Pass Wet - Pass |
| 13 | WETJET | 20 gsm spun-bond, 100% Polypropylene, 0.21 mm thick | Notched + 12 mm over-lap at center, wings separated | No | Yes - 30 gsm thru air, 100% bicomponent, 0.4 mm thick/laminated to apertured film 15 mm wide × 0.6 mm | Dry - Pass Wet - Pass |
| 14 | WETJET | 20 gsm spun-bond, 100% Polypropylene, 0.21 mm thick 20 | Notched + perforation line keeping attachment wings partially attached | No | Yes - 20 gsm spun-bond 36 mm strip | Dry - Pass Wet - Fail |
| 15 | WETJET | 20 gsm spun-bond, 100% Polypropylene, | Notched + perforation line keeping | Yes | Yes - 20 gsm spun-bond 36 mm strip | Dry - Pass Wet - Pass |

TABLE 1-continued

| Example | Type of Cleaning Pad | Wing Material | Wing Configuration | Wings partially bonded to the pad | Loop fasteners or Extra Strip Added | Attachment Pass/Fail |
|---|---|---|---|---|---|---|
| | | 0.21 mm thick 20 | attachment wings partially attached | | | |
| 16 | Clorox Ready mop | 70 gsm apertured spun-lace 70:30 Rayon:PET, 0.75 mm thick | Uniform separated wings + Notch | No | Yes - 20 gsm spun-bond 36 mm strip | Dry - Pass Wet - Fail |
| 17 | Clorox Ready mop | 70 gsm apertured spun-lace 70:30 Rayon:PET, 0.75 mm thick | Uniform separated wings + Notch | Yes | Yes - 20 gsm spun-bond 36 mm strip | Dry - Pass Wet - Pass |
| 18 | Grab-it Go Mop | 250 gsm core embossed onto 15 gsm spun-bond, 3.4 mm thick | Uniform separated wings without Notch | No | Yes - 20 gsm spun-bond 36 mm strip | Dry - Pass Wet - Fail |
| 19 | Grab-it Go Mop | 250 gsm core embossed onto 15 gsm spun-bond, 3.4 mm thick | Uniform separated wings without Notch | Yes | Yes - 20 gsm spun-bond 36 mm strip | Dry - Pass Wet - Pass |

Interpretation of the Results Recorded in Table 1

As previously discussed, The "dry test" and the "wet test" are intended to identify suitable materials which can be used as loop fasteners either to make the attachment wings or to make strips of loop fasteners attached to the pad. In addition, these tests are also intended to identify suitable design configurations of the cleaning pad (attachment wings partially bonded to the top of the cleaning pad, attachment wings partially bonded to each other, need/location of an additional strip of loop fasteners).

The examples I, II and III demonstrate that none of the absorbent cleaning pads currently available on the market (as of November 2002) can be used with various cleaning implements.

The absorbent cleaning pads of examples I and II, which have attachment wings, are suitable to be used with a cleaning implement having retaining means located on the top of a mop head but cannot be used with a cleaning implement having hook type fasteners located at the bottom surface of a mop head.

Conversely, the absorbent cleaning pad of example III, which does not have any attachment wings, can be used with a cleaning implement having hook fasteners at the bottom surface of a mop head but cannot be used with a cleaning implement having retaining means located on the top surface of a mop head.

The cleaning pads of examples 1 through 10 are SWIFFER WETJET® type absorbent cleaning pads which have been modified to include attachment wings made of various materials and having various design configurations. The attachment wings of the pads of examples 1 through 10 are suitable to removably attach the pads to implements which have retaining means located on the top surface of their mop head. In examples 1 through 10, the attachment wings are the sole retainable means used to removably attach the pads to hook type fasteners, i.e. no additional strip of loop fasteners materials is added to the pads.

The attachment wings of the pads of examples 1, 2 and 3 are made of the same material (i.e. a 40 gsm spun-bond material) and show the benefit of creating a partial bond between the attachment wings and the top surface of a pad, or between attachment wings facing each other (perforation line), in particular when the cleaning pad is wet.

The attachment wings of the pad of example 4 have the same design configuration as the attachment wings of example 1, i.e. attachment wings have no partial bond, but are made of a material having a different basis weight (a 20 gsm spun-bond material).

The attachment wings of the pad of example 5 are made of the same material as the attachment wings of example 4 but have a different design configuration, i.e. they are partially bonded to the top surface of the cleaning pad (as in example 2). Example 5 shows that even with a material having a lower basis weight, a partial bond between the attachment wings and the top surface of the pad can be beneficial and enhance the pad retainability.

The attachment wings of example 6 are made of the same material as the attachment wings of examples 4 and 5 and are partially bonded to each other via a perforation line.

The attachment wings of examples 7 are additionally bonded to the top surface of the pad in comparison with the attachment wings of example 6 which are not. Examples 6 and 7 demonstrate the benefit and even superiority of creating a partial bond between the attachment wings and the top surface of the pad.

In addition, examples 3 and 6 show that the basis weight, the thickness, and the degree of stiffness of the material used to make the attachment wings can have an impact on the retainability of a cleaning pad in particular when the cleaning pad is wet.

The attachment wings of the cleaning pads of examples 8 through 10 have the same design configuration, i.e. wings partially bonded to the top surface of the pad as well as wings being partially bonded to each other via a perforation line, but are made of a material (spun-bond/meltblown/spun-bond) having various basis weights.

Surprisingly, with this specific design configuration, it was found that the only cleaning pad which passes both the "dry test" and the "wet test" is the cleaning pad having wings made of the lowest basis weight material. Without intending to be bound by any theory, it is believed that the meltblown component of this type of non-woven material (SMS) has a tendency to pin down some of the grabable fibers of the material. In addition, SMS materials have a lower degree of grabable fibers than the spun-bond materials tested in examples 1 through 7. It is also believed that the hook protrusions of the hook fasteners are better able to "pierce" through the layer of material having the lowest basis weight. This "piercing" ability through the material with the lowest basis weight can explain why the attachment wings of example 10 enhance the pad retainability to the bottom surface of the mop head, in particular when the cleaning pad is wet.

The cleaning pads of examples 11 through 19 are either SWIFFER WETJET®, READY-MOP® or GO-MOP® type cleaning pads which have been modified to include additional strips of loop fasteners materials.

The attachment wings of the cleaning pads of examples 11 and 12 are made of the same type of material but have different design configurations. Additional strips of "optimized" type loop fasteners (3M XPL-99139), such as the ones located on the barrier layer of the currently available SWIFFER WETJET® cleaning pads, were bonded to the top surface of each attachment wings. Examples 11 and 12 show that independently of the design configuration of the attachment wings, the cleanings pads demonstrate excellent retainability to the bottom surface of the mop head. Without intending to be bound by any theory, it is believed that the excellent retainability of these pads is due to the high degree of grabable fibers of the "optimized" strips of loop fasteners.

The additional strips of loop fasteners of the pad of example 13 is made of a thru-air non-woven material which is laminated with an apertured formed film. The thru-air non-woven component is composed of 100% synthetic bicomponent fibers having an inner core, which is a high melt point polymer, and an outer sheath which is a low melt point polymer. This type of non-woven material has a high degree of grabable fibers and, as a result, embossing is not needed to enhance its integrity. The material integrity is obtained by partially melting the outer polymer of the bicomponent, which fuses fibers together to form this substrate. Since the tensile strength of this non-woven is relatively low, it is preferred to laminate this material onto another non-woven in order to create a composite material which has significant grabable fibers with suitable tensile strength.

Examples 11, 12 and 13 show that loop fasteners having a high degree of "fiber to hook" engagements are beneficial independently of the degree of stiffness of the material used to make the wings or the design configuration of the attachment wings on the pad.

Examples 14 and 15 show the benefit of partially bonding the attachment wings to the top surface of a pad when the material, which is used for the additional strips of loop fasteners, has a relatively low basis weight, a low degree of stiffness and a relatively low degree of "fiber to hook" engagements. Without intending to be bound by any theory, it is believed that the partial bonds between the attachment wings and the top surface of the pad can offset the shear forces exerted on the attachment wings which have the tendency to "slide" on the barrier layer of the pad in particular when the pad is wet.

The cleaning pads of examples 16 through 19 are commercially available READY-MOP® and GO-MOP® type cleaning pads which have been modified to include strips of loop fasteners made of a 20 gsm spun-bond material, which are bonded to the top surface of their attachment wings and are tested in various design configurations.

Again, the pads of examples 17 and 19 when compared to the pads of examples 16 and 18 show the benefit of creating a partial bond between the attachment wings and the top surface of the cleaning pad, in particular when the cleaning pads are loaded with a liquid.

As previously discussed, the cleaning pads of examples 1 through 15 are modified SWIFFER WETJET® cleaning pads which are commercially available as of November 2002. These SWIFFER WETJET® cleaning pads have a dry weight of about 20 g and have a total absorbent capacity of about 250 ml of liquid. Consequently, the "wet" weight of the SWIFFER WETJET® cleaning pads is about 270 g. In addition, the bottom layer of these pads, i.e. the layer in direct contact with the floor surface during the mopping operation, is made of an apertured formed polyethelene film which has a coefficient of friction of about 4 g/sqcm when wiped on dry floor surface. One skilled in the art will understand that the results obtained in the "dry" and "wet" tests can be influenced by the "dry" weight and the "wet" weight of the pads being tested. For example, a "lighter" pad is more easily retained by the hook fasteners of a mop head in comparison to a "heavier" pad. Moreover, the cleaning pad total absorbent capacity can also impact on the pad retainability in particular when the pad is completely saturated. For example, two cleaning pads having a same dry weight but having different absorbent capacities do not need loop fasteners having identical retention properties. When both cleaning pads are fully saturated with a liquid, the cleaning pad having the lowest absorbent capacity is "lighter" than the cleaning pad having the highest absorbent since the absorbent capacity measures the ability of a pad to absorb a liquid.

In addition, the coefficient of friction between the bottom layer of a cleaning pad and the floor surface during the cleaning operation can also impact on the pad retainability on the hook fasteners of a mop head. One skilled in the art will understand that when this coefficient of friction is low, the shear forces exerted on the cleaning pad are low in comparison with a high coefficient of friction resulting in more shear forces being exerted on the pad.

Peel Resistance Test:

In order to better identify suitable materials which can be used for the attachment wings and/or the additional strips of loop fasteners, another test is conducted on various types of materials.

A series of Peel Resistance Tests is conducted on non-woven materials to determine their retainability on hook fasteners which are recovered from a SWIFFER WETJET® cleaning implement.

Prior to the test, strips of hook fasteners are removed from the bottom surface of the mop head of SWIFFER WETJET® cleaning implements, which are then adhesively attached to a thin sheet of paper in order to facilitate their manipulation during the tests.

The Peel Resistance tests which are conducted follow the test protocol from ASTM test D 1876-95 (Standard Test Method for Peel Resistance also known as T-Peel Test) with the following minor modifications.

1. The test samples consist of various non-wovens and non-woven laminates tested onto hook fasteners from a SWIFFER WETJET® cleaning implement.
2. The test samples are strips of non-woven which are about 25 mm wide by 128 mm long.

Each test sample is positioned on the top of flat bench. The strips of hook fasteners are about 25 mm by 128 mm long. A strip of hook fasteners is applied against the top of a non-woven test sample such that it is substantially aligned with the test sample. A thin piece (about 2 mm thick) of foam backing material is attached to the bottom surface of a weight of about 550 g, and about 40 mm wide by about 140 mm long, such that it covers the entire bottom surface of the weight. The foam backing material and the weight are then carefully applied on the top of the hook fasteners and the test sample. Without applying extra pressure, the weight is slided gently on the top of the sample, moving the weight 6 inches forward followed by 6 inches backwards. This sliding motion of the weight is repeated three times. The intent is of this sliding motion of the weight is to apply 0.25 psi pressure in a back and forth motion in order to simulate the hook to non-woven engagements both in the Z and X-Y direction which typically occurs when a cleaning implement is being used. Note that the non-woven test samples and the hook fasteners do not require conditioning as recommended in Section 6.1 in ASTM test D1876-95.

3. From this point, the method as described in ASTM test D1876-95 is followed. First, a portion of about 12 mm at the end of the hook/non-woven composite is separated and bent in T-shape as described in Section 5.2 of ASTM test D1876-95.
4. Next, the free unbonded ends are clamped into grippers of a tension testing machine with the hook fasteners on the lower clamp and non-woven on the upper clamp, as described in Section 7.1 of ASTM test D1876-95.
5. The tension machine is turned on and run until the materials are completely separated. The Peel Resistance strength is defined by the Maximum load of force recorded, expressed in grams, while the composite sample is being de-laminated. The test is repeated for a minimum of at least 5 replicates whereby each replicate uses a new piece of non-woven substrate but uses the same piece of hook fasteners for each of the replicates. When a sample of non-woven is tested, the strip of hook fasteners is applied to a new untested piece.

Table 2 provides the results of the peel forces which are measured on different samples of non-woven materials applied to hook fasteners removed from SWIFFER WETJET® implements. For comparison purposes Table 2 also includes a summary from Table 1 of the results obtained from the "dry" and "wet" tests previously discussed.

TABLE 2

Peel Forces Results v. "dry" and "wet" tests

| | | | Attachment wings partially bonded to the top surface of the pad | | Attachment wings partially bonded to each other via perforation line | |
|---|---|---|---|---|---|---|
| Example | Test sample | Peel Force-g | Dry Pad | Wet load | Dry Pad | Wet load |
| 1 | Gop Mop attachment wings material | 1.1 | Fail | Fail | NA | NA |
| 2 | Ready Mop attachment wings material | 19.6 | Fail | Fail | NA | NA |
| 3 | 20 gsm Spun-bond | 73.0 | Pass | Pass | Pass | Pass (1)/Fail(2) |
| 4 | 40 gsm Spun-bond | 60.9 | Pass | Pass | Pass | Pass |
| 5 | 20 gsm SMS | 37.5 | Pass | Pass | Not Tested | Not Tested |
| 6 | 30 gsm SMS | 26.6 | Pass | Fail | Not Tested | Not Tested |
| 7 | 60 gsm SMS | 20.2 | Pass | Fail | Not Tested | Not Tested |
| 8 | 3M loop XPL-99139 | 244.3 | Pass(1) | Pass(1) | Pass(1) | Pass(1) |
| 9 | 30 gsm thru-air laminated 20 gsm apertured film | 163.2 | Not Tested | Not Tested | Pass(1) | Pass(1) |

(1)Material tested as an additional strip of loop fastener located on top of attachment wings
(2)Material tested as actual wing The Peel Force results of the SMS (spun-bond, melblown spun-bond) materials of examples 5, 6 and 7 confirm the surprising result previously stated. The SMS material having the lowest basis weight (example 6) has a greater Peel Force than similar materials having a higher basis weight (examples 6 and 7).

Based on the results recorded in Table 2, it is believed that a material suitable to make the attachment wings of a cleaning pad or to make suitable strip of loop fasteners which can be added to the pad, has a Peel Force of at least about 30 g, preferably at least about 40 g, more preferably at least about 50 g and even more preferably of at least about 60 g in order to provide adequate retainability to a cleaning pad in particular if the cleaning is wet.

In one embodiment, a suitable loop material, can have a Peel Force of less than about 200 g, preferably less than about 180 g, more preferably less than about 150 g.

In one embodiment, a cleaning pad can have loop fasteners such that the cleaning pad is removably attachable to the hook fasteners located at the bottom surface of a mop head. In a preferred embodiment, the loop fastener type material of the cleaning pad is selected such that when the cleaning pad is fully saturated with liquid, the weight of the absorbed liquid in addition to the weight of the pad causes the cleaning pad to drop onto the floor surface head when the mop head is raised above the floor surface. Among other benefits, such a cleaning pad allows a user to know when to replace the pad without having to manipulate the soiled pad to visually check if the pad is still able to absorb more liquid.

Figure 27:
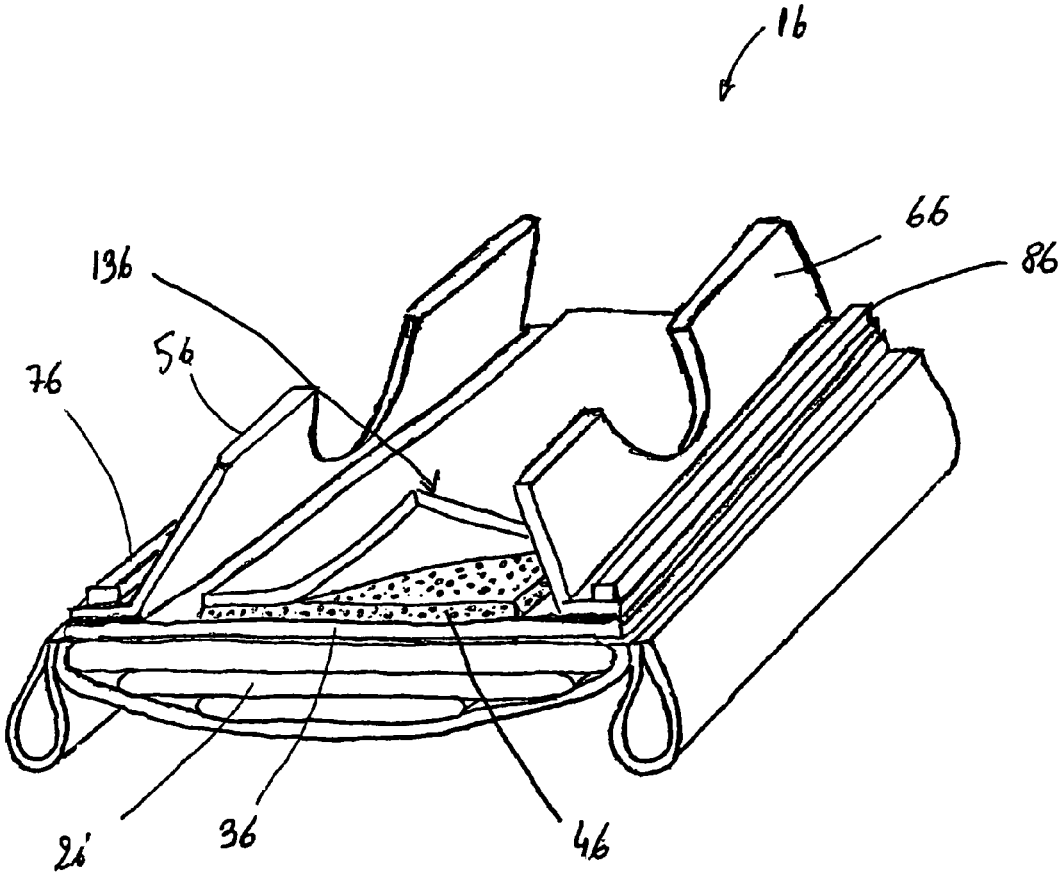
FIG. 27 is an isometric view of another cleaning pad of the invention.

In one embodiment shown in FIG. 27, a pressure sensitive adhesive can be applied onto a portion of at least one layer of any of the previously described cleaning pads such that the cleaning pad can be removably attached to a cleaning implement independently of the presence of retaining means located on the top or bottom surface of the mop head of the implement.

In one embodiment, a cleaning pad 16 comprises an absorbent layer 26, a barrier layer 36 and a pressure sensitive adhesive 46 which is applied to the top surface of the barrier layer 36 such that the cleaning pad 16 is removably attachable to the bottom surface of the mop head of any cleaning implement. The pressure sensitive adhesive 46 is preferably applied to a substantially centered area of the top surface of the barrier layer 36 such that the area covered by the pressure sensitive adhesive has a surface equal to at least about 10%, preferably at least 33%, more preferably at least 66% of the total top surface of the barrier layer 36. The pressure sensitive adhesive 46 can be applied such that it forms a uniform layer, stripes, spirals, beads or any combinations thereof on the top surface of the barrier layer 36. The pressure sensitive adhesive 46 is selected such that it allows the pad to be retained on the bottom surface of a mop head in either a dry or a wet environment. In a preferred embodiment, the pressure sensitive adhesive 46 demonstrates good cohesive properties in order to reduce the risk of having residue left on the bottom surface of a mop head.

In one embodiment, a protecting release sheet of material 136 such as a thin sheet of paper, can be applied on the top of the area covered by the pressure sensitive adhesive 46. Among other benefits, this protecting release sheet of material 136 preserves the tackiness of the pressure sensitive adhesive 46 and also allows the cleaning pads to be folded and/or stack on top of each other for packaging. A user can simply peel off this protecting sheet of material 136 when the user wishes to attach a pad 16 to the bottom surface of a mop head.

One skilled in the art will understand that such a cleaning pad 16 can also have attachment wings 56, 66 and/or additional strips of loop fasteners 76, 86 such that the cleaning pad 16 can also be removably secured to retaining means located on the top or bottom surface of the mop head of a cleaning implement. One skilled in the art will understand that if a user wishes to use a cleaning pad 16 having a pressure sensitive adhesive 46, with a cleaning implement having retaining means located on the top or the bottom surface of the mop head, the user can be instructed not to peel the protecting release sheet 136 from the pad 16.

Figure 28:
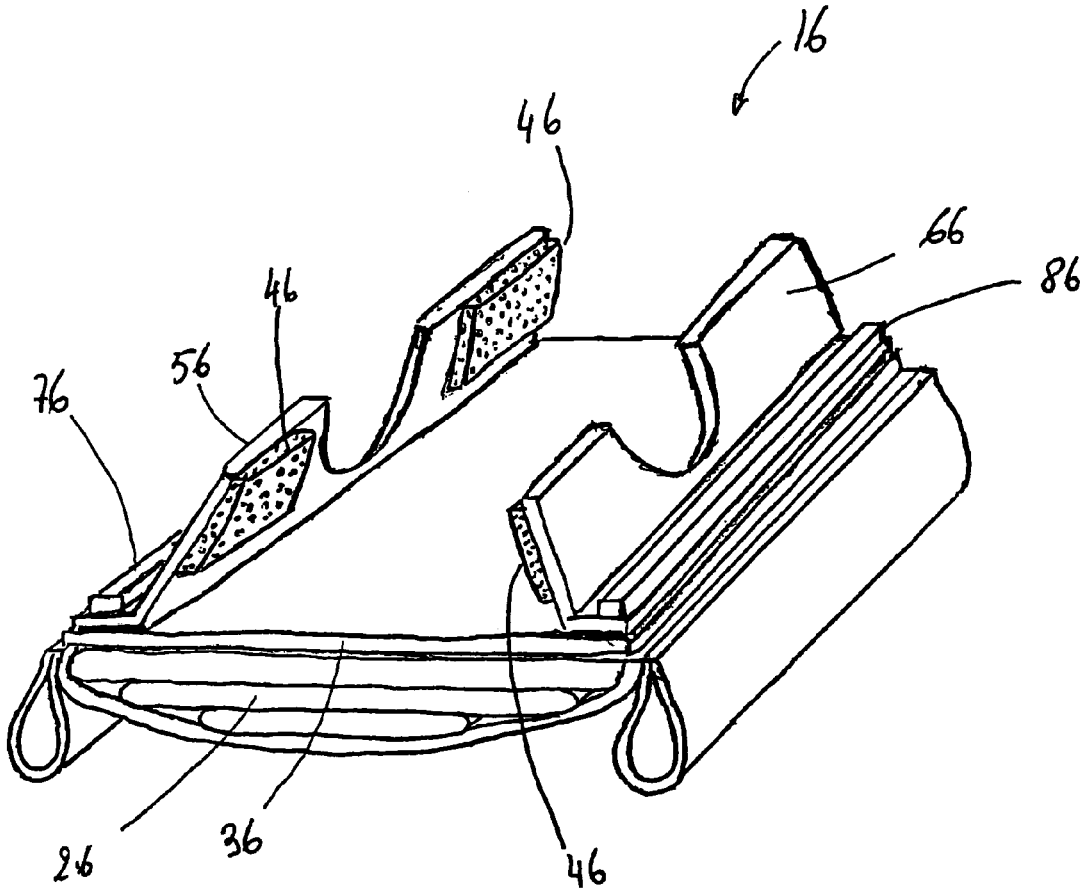
FIG. 28 is an isometric view of another cleaning pad of the invention.

In one embodiment represented in FIG. 28, a pressure sensitive adhesive can be applied to the attachment wings 56, 66 (or attachment wing portions) of any of the previously described cleaning pads. In a preferred embodiment, the pressure sensitive adhesive 46 is applied to the inner surface of the attachment wings 56,66. By "inner surface" it is meant the surface of the attachment wings 56, 66 which faces the top surface of the cleaning pad 16 when the attachment wings 56, 66 are "folded" onto the top of the pad 16, i.e. absorbent layer 26 and/or barrier layer 36. As previously discussed, sheets of protecting release material (not shown) can be applied onto the area of the attachment wings 56, 66 which are respectively covered by the pressure sensitive adhesive 46 in order to preserve the adhesive tackiness over a long period of time. A user can simply remove this protecting release sheet of material when the user wishes to attach a cleaning pad 16 to the top surface of a mop head, in particular when the top surface of the mop head does not have any retaining means. A user can press the inner surface of the attachment wings 56, 66 against the top surface of a mop head such that the pressure sensitive adhesive 46 bonds the attachment wings to the mop head. The skilled artisan will understand that this cleaning pad 16 can also be used with cleaning implements having retaining means located on the top and/or bottom surface of a mop head.

One skilled in the art will understand that such a cleaning pad 16 can also be attach to cleaning implements having retaining means located on the top and/or bottom surface of a mop head.

Figure 29:
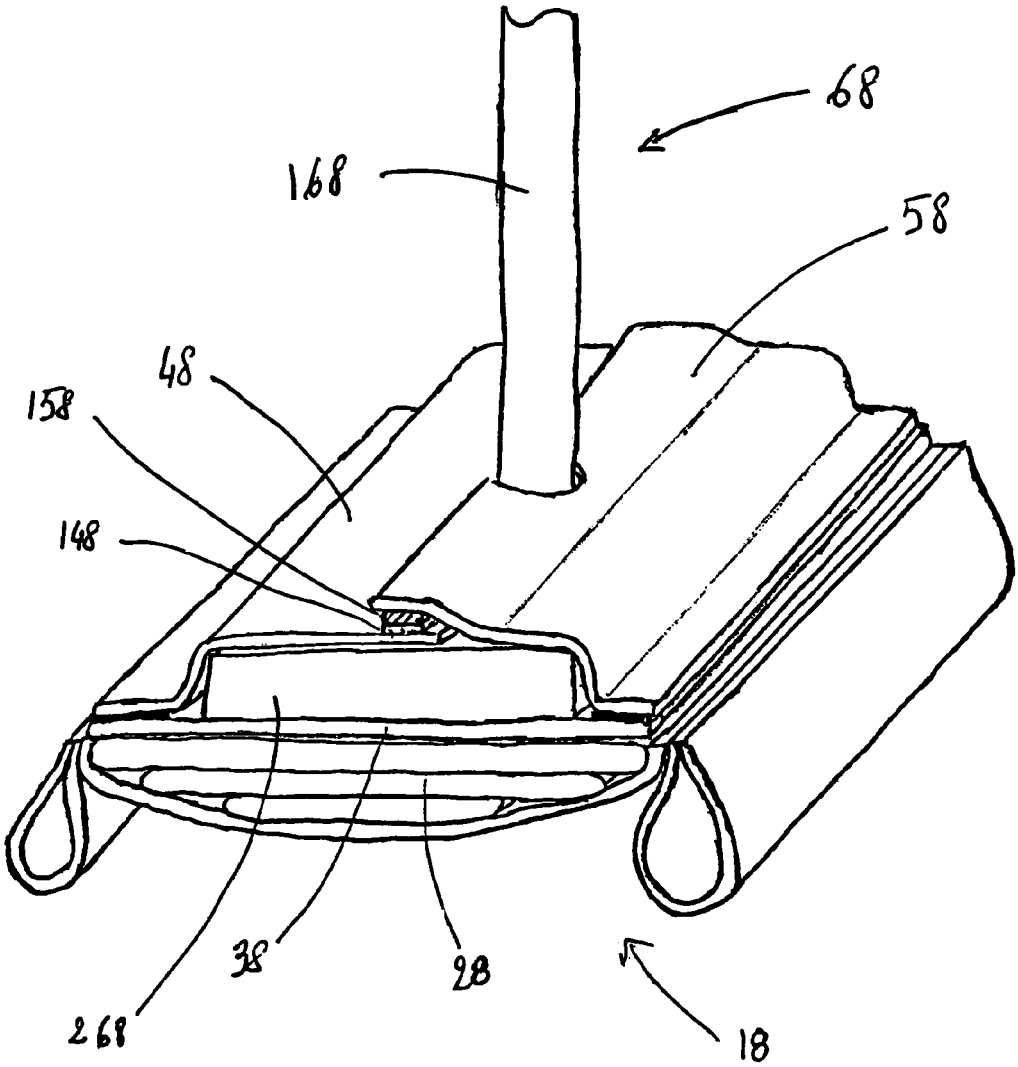
FIG. 29 is an isometric view of another cleaning pad of the invention.

In another embodiment shown in FIG. 29, a cleaning pad 18 can have at least an absorbent layer 28, optionally but preferably a barrier layer 38 attached to the top surface of the absorbent layer 28 and at least two attachment wings 48, 58 respectively attached adjacent to the leading edge and the trailing edge of the pad and which can have securing members 148, 158 for attaching the two attachment wings to each other. In one embodiment, an attachment wing 48 can have a "male" securing member 148 for engaging a "female" securing member of the attachment wing 58. Non-limiting examples of "male" and "female" securing members 148, 158 include snaps, loop and hook fasteners, belt design, adhesive.

Among other benefits, a cleaning pad 18 having attachment wings 48, 58 with male and female securing members 148, 158 can also be attached to a cleaning implement 68 schematically represented in FIG. 29, which comprises a handle 168 and a mop head 268 and which does not have any retaining means suitable to engage and retain a cleaning pad and located on the top or the bottom of a mop head 268. One example of such a cleaning implement is a sponge mop having a handle connected to a substantially flat support head having an absorbent material such as a sponge. During the cleaning operation, a user typically dips the mop head into a bucked filled with a cleaning solution. Once the sponge has absorbed some of the cleaning solution, the user can sweep the floor surface. However, it is often necessary to rinse the floor surface and the amount of liquid left on the surface can take a long time to dry. In addition, most of the soils, bacteria and germs are not removed from the surface when this type of sponge mop is used. It is believed that cleaning pads, in particular cleaning pads having a $T_{1200}$ absorbent capacity of at least 5 g/g, preferably at least 10 g/g, more preferably of at least 20 g/g, which can be used with a cleaning implement having retaining means for engaging and retaining a cleaning pad can drastically improve the cleaning efficacy in terms of reduction of the level of soils, bacteria and germs being left on the floor surface since the cleaning pads absorb the soiled liquid and are then disposed of. As consumers may hesitate to purchase a new cleaning implement, any of the cleaning pads previously described, but preferably the cleaning pads having attachment wings comprising male and female securing member 148, 158, can be sold as a kit. A kit can have at least one, but preferably a plurality of cleaning pads and would allow a consumer to try this type of cleaning pad by using it with any implement having a handle and a support head which does not necessarily have any retaining means for engaging and retaining a cleaning pad. The kit can comprise instructions instructing the consumer to attach a cleaning pad about the support head of an implement, to apply a cleaning solution a floor surface, to sweep the floor surface with the cleaning pad being attached to the implement and then to remove and dispose of the used cleaning pad. The instructions can further instruct the user not to dip the support head with the cleaning pad into a bucket filled with cleaning solution. The instructions can further instruct the user to apply the cleaning solution directly to the floor surface. These instructions can be particularly beneficial when the cleaning pads used with the implement have a relatively low squeeze-out value and/or comprise a super-absorbent material. In another embodiment, a kit further comprises a container filled with a cleaning solution. Non-limiting examples of cleaning solutions are described in Section V. thereafter. In one embodiment, the container can have a cap having a flip top or squirt cap. The container can be a trigger spray container, a squirt bottle or any other container which allows a user to apply the cleaning solution onto the floor surface. The instructions would include explaining that mop head needs to be completely dry before attaching pad. As described above a bottle of cleaning solution could be included in a trial kit to further enhance experience. Among other benefits, this kit allows a consumer to experience the convenience of cleaning systems using the cleaning pads without having to incur the cost of a new cleaning implement. A kit can also include a rebate coupon for a cleaning system comprising a cleaning implement comprising a handle rotatably connected to a mop head, the mop head having retaining means located on the top or bottom surface of the mop head for mechanically retaining a cleaning pad, a fluid delivery mechanism connected to the handle. The fluid delivery mechanism can in fluid communication with a nozzle attached to the mop head for delivering a cleaning solution on a floor surface. The cleaning system can also include a container which is removably attachable to the fluid delivery mechanism.

In order to enable a consumer to try any of the previously disclosed cleaning pads and compare the use of such cleaning pads to more conventional sponge or string mops, or to other type of cleaning implements having suitable retaining means located on the top or the bottom surface of a mop head, it is possible to collect information from a consumer regarding the consumer cleaning habits in terms of cleaning frequency of a floor surface and regarding the type of cleaning implement used by the consumer to clean a floor surface. The information collected can also include the type of floor surface being cleaned (wood surface, linoleum surface, ceramic tile surface) and optionally but preferably the number and size of the rooms been cleaned. The information can be collected by any method known in the art. Non-limiting examples of method for collecting information include, live or phone surveys, surveys sent by mail or by email, surveys obtained during the consumer visit of a web site in the Internet and any combinations thereof. When the information is collected, it is possible to select a system of cleaning products for a floor surface depending on the information collected. For example, a consumer who owns a cleaning implement which does not have retaining means located on the top or the bottom surface of a mop head and suitable for removably retaining a cleaning pad, can be provided with at least one substantially dry cleaning pad comprising attachment wings which have "male" and "female" securing members and optionally a container with a cleaning solution. Another example can be a consumer who owns a cleaning implement having retaining means located on the top surface of the mop head but which does not include a build-in liquid delivery mechanism. In this example, the consumer can be provided with a substantially dry cleaning pad having attachment wings (or attachment wing portions) and a container with a cleaning solution. The number of cleaning pads provided in the system can be related to the floor surface cleaning frequency of the consumer. In one embodiment, the system can be a kit comprising at least one of any of the previously discussed cleaning pads which can be selected depending on the type of cleaning implement used by the consumer as well as the cleaning frequency. In one embodiment, the system can also include a container comprising a cleaning solution. The consumer can also be provided with information including instructions on how to attach and use the cleaning pads as previously described.

V. Miscellaneous

Absorbent Material(s) Suitable for the Absorbent Layer.

A cleaning pad of the present invention comprises at least one absorbent layer.

The layers forming the cleaning pad including the absorbent layer(s) are preferably made of a material such that the cleaning pad has a $T_{1200}$ absorbent capacity of at least 5 g/g, more preferably at least 10 g/g, most preferably of at least 20 g/g.

Non-limiting examples of absorbent materials suitable for the absorbent layer of a cleaning pad include natural fibers (modified or unmodified) such as cotton, Esparto grass, bagasse, kemp, flax, silk, wool, wood pulp, chemically modified wood pulp, jute, ethyl cellulose, and cellulose acetate, as well as synthetically made fibers which can be made from polyvinyl chloride, polyvinyl fluoride, polytetrafluoroethylene, polyvinylidene chloride, polyacrylics such as ORLON®, polyvinyl acetate, Rayon®, polyethylvinyl acetate, non-soluble or soluble polyvinyl alcohol, polyolefins such as polyethylene (e.g., PULPEX®) and polypropylene, polyamides such as nylon, polyesters such as DACRON® or KODEL®, polyurethanes, polystyrenes, and the like.

In one embodiment, the absorbent layer(s) can comprise solely naturally occurring fibers, solely synthetic fibers, or any compatible combination of naturally occurring and synthetic fibers.

The fibers useful herein can be hydrophilic, hydrophobic or can be a combination of both hydrophilic and hydrophobic fibers. Suitable hydrophilic fibers for use in the present invention include cellulosic fibers, modified cellulosic fibers, rayon, polyester fibers such as hydrophilic nylon (HYDROFIL®). Suitable hydrophilic fibers can also be obtained by hydrophilizing hydrophobic fibers, such as surfactant-treated or silica-treated thermoplastic fibers derived from, for example, polyolefins such as polyethylene or polypropylene, polyacrylics, polyamides, polystyrenes, polyurethanes and the like.

Suitable wood pulp fibers can be obtained from well-known chemical processes such as the Kraft and sulfite processes, as well as from mechanical processes, such as ground wood, refiner mechanical, thermomechanical, chemimechanical, and chemi-thermomechanical pulp processes.

In addition, fibers can optionally be thermally-bonded with a thermoplastic material to provide additional overall integrity to the cleaning pad. Thermoplastic materials useful in the present invention can be in any of a variety of forms including particulates, fibers, or combinations of particulates and fibers. The thermoplastic materials, and in particular the thermoplastic fibers, can be made from a variety of thermoplastic polymers, including polyolefins such as polyethylene (e.g., PULPEX®) and polypropylene, polyesters, copolyesters, polyvinyl acetate, polyethylvinyl acetate, polyvinyl chloride, polyvinylidene chloride, polyacrylics, polyamides, copolyamides, polystyrenes, polyurethanes and copolymers of any of the foregoing such as vinyl chloride/vinyl acetate, and the like.

Suitable thermoplastic fibers can be made from a single polymer (monocomponent fibers), or can be made from more than one polymer (e.g., bicomponent fibers).

The absorbent layer(s) of the cleaning pad can also be comprised of a homogeneous material, such as a blend of cellulosic fibers (optionally thermally bonded) and any superabsorbent materials known in the art. As used herein, the term "superabsorbent material" means any absorbent material having a g/g capacity for water of at least about 15 g/g, when measured under a confining pressure of 0.3 psi. Because a majority of the cleaning fluids useful with the present invention are aqueous based, it is preferred that the superabsorbent materials have a relatively high g/g capacity for water or water-based fluids. Non-limiting examples of suitable superabsorbent materials include water insoluble, water-swellable superabsorbent gelling polymers (referred to herein as "superabsorbent gelling polymers") which are described in U.S. patent application Ser. No. 09/831,480 to Policicchio et al., filed Nov. 9, 1999, and assigned to The Procter & Gamble Company, which also describe a method of measuring the $T_{1200}$ absorbent capacity. These materials demonstrate very high absorbent capacities for water.

Alternatively, the absorbent layer can be comprised of discrete layers of material, such as a layer of thermally bonded airlaid material and a discrete layer of a superabsorbent material.

In a preferred embodiment, the absorbent layer will comprise a thermally bonded airlaid web of cellulose fibers (Flint River, available from Weyerhaeuser, Wash.) and AL Thermal C (thermoplastic available from Danaklon a/s, Varde, Denmark), and a swellable hydrogel-forming superabsorbent polymer. The superabsorbent polymer is preferably incorporated such that a discrete layer is located near the surface of the absorbent layer which is remote from the floor sheet. Preferably, a thin layer of, e.g., cellulose fibers (optionally thermally bonded) are positioned above the superabsorbent gelling polymer to enhance containment.

Optional Liquid Pervious Floor Sheet.

The floor sheet is the portion of the cleaning pad that contacts the soiled surface during cleaning. As such, materials useful as the floor sheet must be sufficiently durable that the layer will retain its integrity during the cleaning process. In addition, when the cleaning pad is used in combination with a solution, the floor sheet must be liquid pervious, at least in part, to be capable of transitioning liquids and soils to the absorbent layer. The floor sheet can be a monolayer, or a multi-layer structure one or more of whose layers can be slitted to facilitate the scrubbing of the soiled surface and the uptake of particulate matter. The floor sheet preferably contains openings (e.g., slits, tapered capillaries or apertures) that provide an easy avenue for larger particulate matter to move freely in and become entrapped within the absorbent layer of the pad. Low density structures are preferred for use as the floor sheet, to further facilitate transport of particulate matter to the pad's absorbent layer. The floor sheet can be made of any known pervious material in the art such as the ones described in PCT application Serial No. WO 00/27271 to Policicchio et al, filed Nov. 9, 1999, and assigned to The Procter & Gamble Company. Non-limiting examples of suitable pervious materials for the floor sheet include woven and nonwoven materials; polymeric materials such as apertured formed thermoplastic films, apertured plastic films, and hydroformed thermoplastic films; porous foams; reticulated foams; reticulated thermoplastic films; and thermoplastic scrims. Suitable woven and nonwoven materials can comprise natural fibers (e.g., wood or cotton fibers), synthetic fibers such as polyolefins (e.g., polyethylene and polypropylene), polyesters, polyamides, and synthetic cellulosics (e.g., RAYON®), or from a combination of natural and synthetic fibers. In a preferred embodiment, the cleaning pad 10 comprises a liquid pervious floor sheet which comprises, at least in part, an apertured formed film.

In one embodiment, the floor sheet can also comprise, at least on a portion of the pad's lower surface, a material that provides significant texture to the pad. For example, a preferred means for providing such texture is to form a multilayer composite comprising a scrim material (e.g., polypropylene) and a spunlaced material (e.g., polyester).

Cleaning Solutions.

As previously discussed, cleaning pads can be used with a cleaning implement having a built-in fluid delivery mechanism an/or with a cleaning implement and a container allowing the user to dispense a cleaning solution directly onto the floor surface.

The cleaning solution comprises water, at least a surfactant, optionally a solvent, optionally a sud suppressor, optionally a buffer, optionally a polymer, optionally a perfume, and optionally an antibacterial agent.

Non-limiting examples of suitable composition are described in U.S. patent application Ser. No. 09/655,221 to Godfroid et al., filed Sep. 5, 2000, U.S. patent application Ser. No. 09/671,718 to Sherry et al., filed Sep. 27, 2000 and U.S. patent application Ser. No. 09/671,080 to Godfroid et al., filed Sep. 27, 2000, all assigned to The Procter & Gamble Company.

While particular embodiments of the subject invention have been described, it will be apparent to those skilled in the art that various changes and modifications of the subject invention can be made without departing from the spirit and scope of the invention. In addition, while the present invention has been described in connection with certain specific embodiments thereof, it is to be understood that this is by way of limitation and the scope of the invention is defined by the appended claims which should be construed as broadly as the prior art will permit.

What is claimed is:

1. A cleaning pad usable with a first cleaning implement having a first mop head having a length and a width and retaining means located on the top of said first mop head and with a second cleaning implement having a second mop head having a length and a width and retaining means located on the bottom surface of said mop head, said cleaning pad comprising:

an absorbent layer having a top and a bottom surface, a length and a width, wherein the width of said absorbent layer is greater than the width of the mop head of said first cleaning implement such that said absorbent layer comprises a first and a second attachment wing portion wherein said first and second attachment wing portions are removably attachable to said retaining means located on the top surface of the mop head of said first cleaning implement and wherein said first and second attachment wing portions are folded on the top of said absorbent layer thereby forming a first and a second folding line, such that each of said first and second attachment wing portion at least partially covers the top surface of said absorbent layer; and at least one strip of mechanical fasteners attached to said cleaning pad such that said cleaning pad is removably attachable to said retaining means located on the bottom surface of the mop head of said second cleaning implement.

2. The cleaning pad of claim 1 wherein said retaining means located on the bottom surface of the mop head of said second cleaning implement are hook fasteners and wherein said cleaning pad comprises a first strip of loop fasteners attached to the top surface of said first folded attachment wing portion and a second strip of loop fasteners attached to the top surface of said second folded attachment wing portion such that said first and second strips of loop fasteners are directly attachable to said hook fasteners.

3. The cleaning pad of claim 2 wherein said first strip of loop fasteners is substantially adjacent to said first folding line and said second strip of loop fasteners is substantially adjacent to said second folding line.

4. The cleaning pad of claim 2 wherein said first and second attachment wing portions are partially bonded to the top surface of said absorbent layer.

5. The cleaning pad of claim 2 wherein said first attachment wing portion is partially bonded to said second attachment wing portion.

6. The cleaning pad of claim 1 further comprising an impervious layer attached to the top surface of said first and second attachment wing portions.

7. The cleaning pad of claim 6 wherein said retaining means located on the bottom surface of the mop head of said second cleaning implement are hook fasteners and wherein said impervious layer comprises a first strip of loop fasteners attached to the portion of said impervious layer covering said first attachment wing portion and a second strip of loop fasteners attached to the portion of said impervious layer covering said second attachment wing portion such that said first and second strips of loop fasteners are directly attachable to said hook fasteners.

8. The cleaning pad of claim 7 wherein said impervious layer comprises a perforation line along the length of said impervious layer.

9. The cleaning pad of claim 1 wherein at least one of said first and second attachment wing portions comprises a notch.

10. The cleaning pad of claim 1 wherein said at least one strip of mechanical fastener is made of a material having a Peel Force of at least about 30 g.

11. A cleaning pad usable with a first cleaning implement having a mop head having a length and a width and retaining means located on the top of said mop head and with a second cleaning implement having a mop head having a length and a width and retaining means located on the bottom surface of said mop head, said cleaning pad comprising:

an absorbent layer having a length and a width;

a floor sheet having a length and a width wherein said floor sheet is in direct fluid communication with said absorbent layer and wherein the width of said floor sheet is greater than the width of the mop head of said first cleaning implement such that said floor sheet comprises a first and a second attachment wing portion wherein said first and second attachment wing portions are removably attachable to said retaining means located on the top surface of the mop head of said first cleaning implement and wherein said first and second attachment wing portions are folded on the top of said absorbent layer thereby forming a first and a second folding line, such that each of said first and second attachment wing portion covers at least partially the top surface of said absorbent layer; and at least one strip of loop fasteners attached to said cleaning pad such that said cleaning pad is removably attachable to said retaining means located on the bottom surface of the mop head of said second cleaning implement.

12. The cleaning pad of claim 11 wherein said retaining means located on the bottom surface of the mop head of said second cleaning implement are hook fasteners and wherein said cleaning pad comprises a first strip of loop fasteners attached to the top surface of said first folded attachment wing portion and a second strip of loop fasteners attached to the top surface of said second folded attachment wing portion such tat said first and second strips of loop fasteners are directly attachable to said hook fasteners.

13. The cleaning pad of claim 12 wherein said first strip of loop fasteners is substantially adjacent to said first folding line and said second strip of loop fasteners is substantially adjacent to said second folding line.

14. The cleaning pad of claim 12 wherein said cleaning pad further comprises an impervious layer attached to said absorbent layer such that said impervious layer is located between said first and second folded attachment wing portions and said absorbent layer.

15. The cleaning pad of claim 14 wherein said first and second folded attachment wing portions are partially bonded to the top surface of said impervious layer.

16. The cleaning pad of claim 14 wherein said first folded attachment wing portions is partially bonded to said second folded attachment wing portion.

17. The cleaning pad of claim 11 wherein at least one of said first and second attachment wing portions comprises a notch.

18. The cleaning pad of claim 11 wherein said at least one strip of loop fastener is made of a material having a Peel Force of at least about 30 g.

19. A cleaning pad usable with a first cleaning implement having a mop head having a length and a width and retaining means located on the top of said mop head and with a second cleaning implement having a mop head having a length and a width and retaining means located on the bottom surface of said mop head, said cleaning pad comprising:

an absorbent layer having a top and a bottom surface, a length and a width, a leading and a trailing edge;

a first attachment wing connected to said leading edge of said absorbent layer wherein said first attachment wing is removably attachable to said retaining means of said first cleaning implement;

a second attachment wing connected to said trailing edge of said absorbent layer wherein said second attachment wing is removably attachable to said retaining means of said first cleaning implement;

wherein said first and second attachment wings are folded on the top of said absorbent layer thereby forming a first and a second folding line, such that each of said first and second attachment wing covers at least partially the top surface of said absorbent layer and such that said cleaning pad is directly attachable to said retaining means of said second cleaning implement, and wherein said first and second attachment wings are made of a material having a Peel Force of at least about 30 g.

20. The cleaning pad of claim 19 wherein said first and second attachment wings are partially bonded to the top surface of said absorbent layer.

21. The cleaning pad of claim 19 wherein said first attachment wing is partially bonded to said second attachment wing.

22. The cleaning pad of claim 19 wherein said cleaning pad further comprises an impervious layer attached to said absorbent layer such tat said impervious layer is located between said first and second folded attachment wings and said absorbent layer.

23. The cleaning pad of claim 22 wherein said first and second attachment wings are partially bonded to the top surface of said absorbent layer.

24. The cleaning pad of claim 22 wherein said first attachment wing is partially banded to said second attachment wing.

25. A cleaning pad usable with a first cleaning implement having a mop head having a length and a width and retaining means located on the top of said map head and with a second cleaning implement having a mop head having a length and a width and retaining means located on the bottom surface of said mop head, said cleaning pad comprising:

an absorbent layer having a top and a bottom surface, a length and a width, a leading and a trailing edge;

an attachment layer connected to said absorbent layer substantially adjacent to said leading edge and said trailing edge of said absorbent layer, wherein said attachment layer comprises a breakable perforation line along its length and such that a first and a second attachment wings are removably attachable to said retaining means of said first cleaning implement when said perforation line is broken and wherein said attachment layer is removably attachable to the retaining means of said second cleaning element when said perforation line is not broken.

26. The cleaning pad of claim 25 wherein said cleaning pad further comprises a first strip of loop fasteners attached to the top surface of said attachment layer and located substantially adjacent to said leading edge and a second strip of loop fasteners attached to the top surface of said attachment layer and located substantially adjacent to said trailing edge.

27. The cleaning pad of claim 26 wherein said first and second strip of loop fasteners are made of a material having a peel for of at least about 30 g.

28. The cleaning pad of claim 27 wherein cleaning pad further comprises an impervious layer attached to said absorbent layer such that said impervious layer is located between said attachment layer and said absorbent layer.

29. The cleaning pad of claim 28 wherein said attachment layer is partially bonded to said impervious layer via a first and a second partial bond, wherein said first partial bond is located between said leading edge and said breakable perforation line and said second partial bond is located between said breakable perforation line and said trailing edge.

30. A cleaning pad usable with a first cleaning implement having a mop head having a length and a width and retaining means located on the top of said mop head and with a second cleaning implement having a mop head having a length and a width and retaining means located on the bottom surface of said mop head, said cleaning pad comprising:

an absorbent layer having a top and a bottom surface, a length and a width, a leading and a trailing edge;

an impervious layer attached to the top surface of said absorbent layer;

a first attachment wing connected to said impervious layer wherein said first attachment wing is removably attachable to said retaining means of said first cleaning implement;

a second attachment wing connected to said impervious layer wherein said second attachment wing is removably attachable to said retaining means of said first cleaning implement;

a first strip of loop fasteners attached to the top surface of said first attachment wing; and a second strip of loop fasteners attached to the top surface of said second attachment wing, wherein said first and second attachment wings are folded on the top of said impervious layer thereby forming first and a second folding line, such that each of said first and second attachment wing covers at least partially the top surface of said impervious layer and such that said cleaning pad is directly attachable to said retaining means of said second cleaning implement;

wherein said first and second strips of loop fasteners are made of a material having a Peel Force of at least 30 g.

31. The cleaning pad of claim 30 wherein said first and second attachment wings are partially bonded to the top surface of said impervious layer.

32. The cleaning pad of claim 30 wherein said first attachment wing is partially bonded to said second attachment wing.

33. The cleaning pad of claim 30 wherein said first strip of loop fasteners is located adjacent said first folding line and wherein said second strip of loop fastener is located adjacent said second folding line.

* * * * *